US010078980B2

(12) United States Patent
Kong et al.

(10) Patent No.: US 10,078,980 B2
(45) Date of Patent: Sep. 18, 2018

(54) DATA DRIVER, DISPLAY DRIVING CIRCUIT, AND OPERATING METHOD OF DISPLAY DRIVING CIRCUIT

(71) Applicant: SAMSUNG ELECTRONICS CO., LTD., Suwon-si (KR)

(72) Inventors: Ki-ho Kong, Suwon-si (KR); Hong-keun Yune, Seoul (KR); Jee-hwal Kim, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 15/496,497

(22) Filed: Apr. 25, 2017

(65) Prior Publication Data

US 2017/0309219 A1 Oct. 26, 2017

(30) Foreign Application Priority Data

Apr. 25, 2016 (KR) ..... 10-2016-0050122
Feb. 14, 2017 (KR) ..... 10-2017-0020138

(51) Int. Cl.
*G09G 3/20* (2006.01)

(52) U.S. Cl.
CPC ..... *G09G 3/2092* (2013.01); *G09G 3/2003* (2013.01); *G09G 2300/0426* (2013.01); *G09G 2310/08* (2013.01); *G09G 2330/021* (2013.01)

(58) Field of Classification Search
CPC .. G09G 3/2092; G09G 3/3685–3/3688; G09G 2310/027; G09G 2310/0264
See application file for complete search history.

(56) References Cited

U.S. PATENT DOCUMENTS

| | | | | |
|---|---|---|---|---|
| 7,471,272 | B2 | 12/2008 | Oelhafen et al. | |
| 8,704,814 | B2 | 4/2014 | Yen | |
| 8,717,338 | B2 | 5/2014 | Son et al. | |
| 8,860,704 | B2 | 10/2014 | Lee | |
| 8,970,465 | B2 * | 3/2015 | Woo | G09G 5/02 345/204 |
| 9,082,367 | B2 | 7/2015 | Nagao | |
| 9,269,321 | B2 | 2/2016 | Jamshidi-Roudbari et al. | |
| 2008/0218500 | A1 | 9/2008 | Akai et al. | |
| 2012/0169783 | A1 * | 7/2012 | Park | G09G 3/3614 345/690 |

(Continued)

FOREIGN PATENT DOCUMENTS

JP 2005-017771 A 1/2005

*Primary Examiner* — Michael Pervan
(74) *Attorney, Agent, or Firm* — Sughrue Mion, PLLC

(57) ABSTRACT

A data driver and a display driving circuit are provided. The display driving circuit includes a first gamma voltage generator that supplies a first gamma voltage set, a second gamma voltage generator that supplies a second gamma voltage set, a first channel driver that outputs a selected one of gamma voltages of the first gamma voltage set, and a second channel driver that outputs a selected one of gamma voltages of the second gamma voltage set. In a first operation mode, the first channel driver and the second channel driver respectively drive a first data line and a second data line of a display panel, and in a second operation mode, the second gamma voltage generator and the second channel driver are disabled, and the first channel driver time-divisionally drives the first data line and the second data line, based on the first gamma voltage set.

20 Claims, 25 Drawing Sheets

(56) References Cited

U.S. PATENT DOCUMENTS

| | | | | |
|---|---|---|---|---|
| 2014/0160104 | A1* | 6/2014 | Lin | G09G 3/3614 345/212 |
| 2014/0253532 | A1* | 9/2014 | Woo | G09G 5/00 345/212 |
| 2014/0306872 | A1 | 10/2014 | Yun et al. | |
| 2016/0078835 | A1 | 3/2016 | Cho et al. | |
| 2016/0098966 | A1* | 4/2016 | Kim | G09G 3/3614 345/690 |
| 2017/0287429 | A1* | 10/2017 | Kong | G09G 3/3607 |
| 2017/0336851 | A1* | 11/2017 | Bae | G06F 1/3265 |

* cited by examiner

DATA DRIVER, DISPLAY DRIVING CIRCUIT, AND OPERATING METHOD OF DISPLAY DRIVING CIRCUIT

CROSS-REFERENCE TO RELATED APPLICATION

This application claims priority to Korean Patent Application No. 10-2016-0050122, filed on Apr. 25, 2016, in the Korean Intellectual Property Office, and Korean Patent Application No. 10-2017-0020138, filed on Feb. 14, 2017 in the Korean Intellectual Property Office, the disclosures of which are incorporated by reference herein in their entirety.

BACKGROUND

The inventive concept relates to a semiconductor device, and more particularly, to a data driver and a display driving circuit, which drive a display panel in order for an image to be displayed on the display panel.

Recently, display apparatuses may support an always-on display (AOD) mode where an image is always displayed. In order to increase the operable time of batteries that provide power for the display apparatus, various technologies for reducing the power consumption of a display driving circuit in a low power operation mode such as the AOD mode are being researched.

SUMMARY

It is an aspect to provide a data driver and a display driving circuit, in which consumption power is reduced.

According to an aspect of the inventive concept, there is provided a display driving circuit including a first gamma voltage generator configured to supply a first gamma voltage set, a second gamma voltage generator configured to supply a second gamma voltage set, a first channel driver configured to receive the first gamma voltage set and select one gamma voltage from among gamma voltages of the first gamma voltage set to output the selected one gamma voltage, and a second channel driver configured to receive the second gamma voltage set and select one gamma voltage from among gamma voltages of the second gamma voltage set to output the selected one gamma voltage, wherein in a first operation mode, the first channel driver and the second channel driver respectively drive a first data line and a second data line of the display panel, and in a second operation mode, the second gamma voltage generator and the second channel driver are disabled, and the first channel driver time-divisionally drives the first data line and the second data line, based on the first gamma voltage set.

According to another aspect of the inventive concept, there is provided a data driver including a gamma block including a first gamma voltage generator and a second gamma voltage generator that each generate a plurality of gamma voltages and a driving block including a plurality of first channel drivers receiving a plurality of gamma voltages from the first gamma voltage generator and a plurality of second channel drivers receiving another plurality of gamma voltages from the second gamma voltage generator, wherein in a low power mode, the second gamma voltage generator and the plurality of second channel drivers are disabled, and the plurality of first channel drivers drive a plurality of data lines of a display panel, based on the plurality of gamma voltages supplied from the first gamma voltage generator.

According to another aspect of the inventive concept, there is provided a display driving circuit comprising a plurality of gamma voltage generators, each configured to output a respective gamma voltage set; a plurality of channel drivers configured to receive the gamma voltage sets, each channel driver configured to select one gamma voltage and output the selected one gamma voltage, wherein in a first operation mode, the gamma voltage generators and the channel drivers are all enabled and each channel driver drives a respective data line of a display panel with the gamma voltage selected by the channel driver, and in a second operation mode, at least one but not all of the gamma voltage generators are disabled and one or more but not all of the channel drivers are disabled, and an enabled one of the channel drivers time-divisionally drives a plurality of data lines, with a gamma voltage from an enabled one of the gamma voltage generators.

BRIEF DESCRIPTION OF THE DRAWINGS

Exemplary embodiments will be more clearly understood from the following detailed description taken in conjunction with the accompanying drawings in which.

DETAILED DESCRIPTION

Hereinafter, exemplary embodiments will be described with reference to the accompanying drawings.

Figure 1:
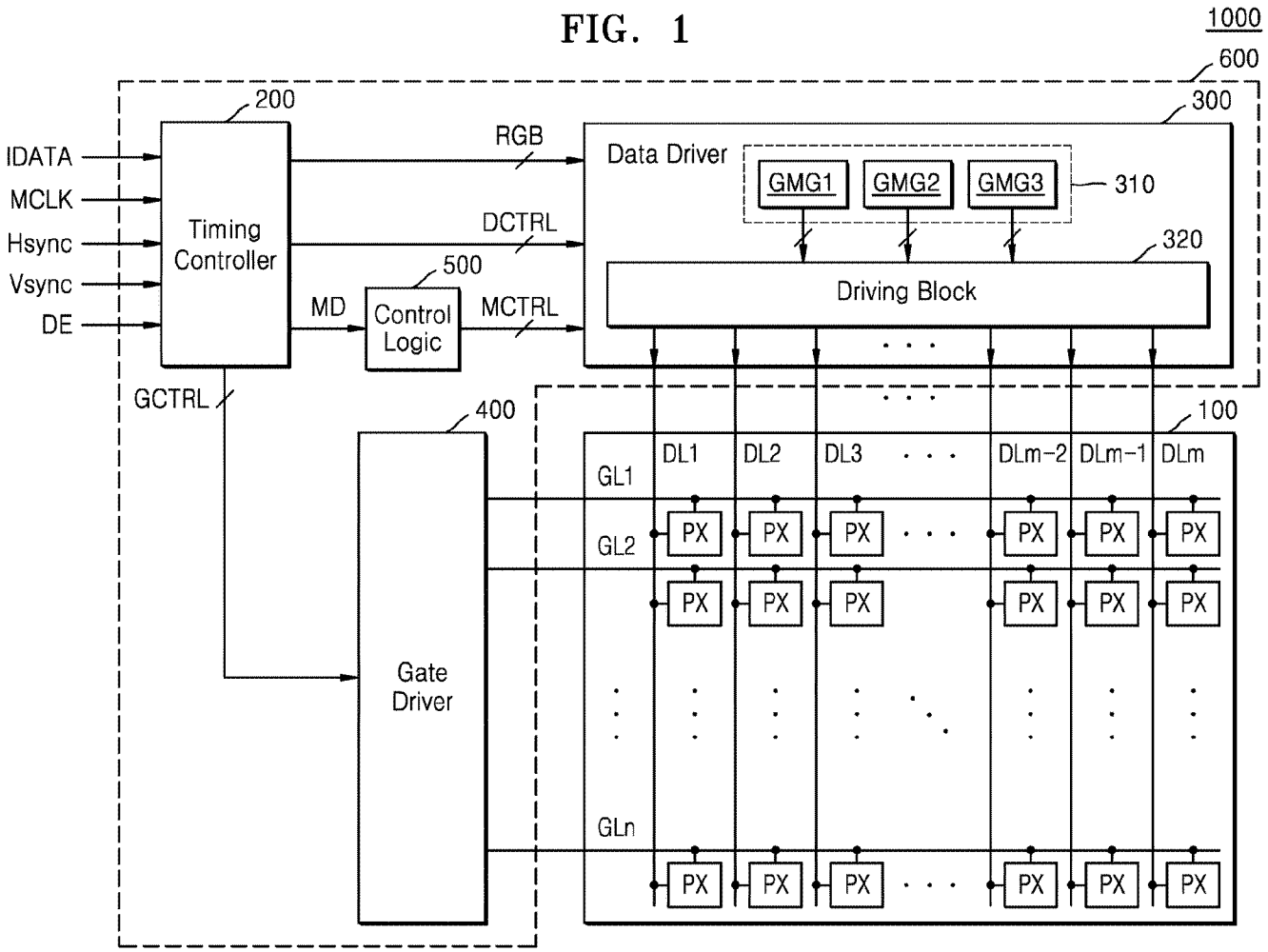
FIG. 1 is a block diagram illustrating a display apparatus according to an exemplary embodiment.

FIG. 1 is a block diagram illustrating a display apparatus 1000 according to an exemplary embodiment.

Referring to FIG. 1, the display apparatus 1000 may include a display panel 100, a timing controller 200, a control logic 500, a data driver 300, and a gate driver 400. The timing controller 200, the control logic 500, the data driver 300, and the gate driver 400 may be collectively referred to as a display driving circuit 600 (display driver integrated circuit (IC)) (DDI) for driving the display panel 100. In an exemplary embodiment, at least two of the timing controller 200, the control logic 500, the data driver 300, and the gate driver 400 may be integrated into one semiconductor chip. However, the present exemplary embodiment is not limited thereto, and the timing controller 200, the control logic 500, the data driver 300, and the gate driver 400 may be implemented as different semiconductor chips. In other exemplary embodiments, at least one element (for example, the gate driver 400) may be integrated into the display panel 100.

The display panel 100 may include a plurality of pixels PX and may display an image in units of one frame. The plurality of pixels may be arranged in a matrix form. The display panel 100 may be implemented with one of a liquid crystal display (LCD), a light-emitting diode (LED) display, an organic LED (OLED) display, an active-matrix OLED (AMOLED) display, an electrochromic display (ECD), a digital mirror device (DMD), an actuated mirror device (AMD), a grating light valve (GLV), a plasma display panel (PDP), an electro luminescent display (ELD), and a vacuum fluorescent display (VFD) or may be implemented with another kind of flat panel display or flexible display.

The display panel 100 may include a plurality of gate lines GL1 to GLn arranged in a row direction, a plurality of data lines DL1 to DLm arranged in a column direction, and a plurality of pixels PX respectively provided in a plurality of pixel areas defined by intersections of the gate lines GL1 to GLn and the data lines DL1 to DLm. The display panel 100 may include a plurality of horizontal lines (or rows), and each of the plurality of horizontal lines may include pixels PX connected to a corresponding gate line. Hereinafter, a horizontal line may be briefly referred to as a line. In one horizontal driving period, pixels PX of one horizontal line may be driven, and in a next horizontal driving period, pixels PX of another one line may be driven. For example, in a first horizontal driving period, pixels PX connected to a first gate line GL1 may be driven, and in a second horizontal driving period, pixels PX connected to a second gate line GL2 may be driven.

The gate lines GL1 to GLn may be sequentially driven according to a gate-on signal output from the gate driver 400, and grayscale voltages corresponding to pixels PX connected to a selected gate line may be respectively applied to the pixels PX through the data lines DL1 to DLm, whereby a display operation may be performed.

The gate driver 400 may sequentially supply the gate-on signal to the gate lines GL1 to GLn in response to a gate driver control signal GCTRL supplied from the timing controller 200, thereby sequentially selecting the gate lines GL1 to GLn.

In response to a data driver control signal DCTRL supplied from the timing controller 200, the data driver 300 may convert image data RGB obtained through conversion into image signals which are analog signals, and may respectively supply the image signals to the data lines DL1 to DLn. For example, the data driver 300 may convert pixel data corresponding to each pixel PX into a gamma voltage (or a grayscale voltage). The data driver 300 may respectively supply image signals for one line to the data lines DL1 to DLm during one horizontal driving period.

The data driver 300 may include a gamma block 310 and a driving block 320.

The gamma block 310 may generate a gamma voltage set corresponding to each of the colors of image data. In the display panel 100, gray scales of pixels PX may not be changed linearly but may be changed nonlinearly according to a voltage level of a supplied image signal. In order to prevent image quality from being degraded due to such a gamma characteristic, a gamma voltage set including a plurality of gamma voltages in which the gamma characteristic is reflected may be previously generated, and a selected gamma voltage corresponding to pixel data among the plurality of gamma voltages may be supplied as an image signal to a data line.

The gamma voltage set may include a plurality of gamma voltages (or grayscale voltages) corresponding to values of pixel data. For example, if the pixel data includes an 8-bit digital signal, the gamma voltage set may include $2^8$ gamma voltages.

The gamma block 310 according to an exemplary embodiment may include a plurality of gamma voltage generators GMG1 to GMG3. The plurality of gamma voltage generators GMG1 to GMG3 may generate, for example, a gamma voltage set corresponding to each of red, green, and blue or may generate a gamma voltage set corresponding to a color of an image signal output from a channel driver connected to a corresponding gamma voltage generator. Although in FIG. 1 three gamma voltage generators GMG1 to GMG3 are illustrated, the gamma block 310 may include two or more gamma voltage generators without being limited thereto. In an exemplary embodiment, the gamma block 310 may be implemented as a module independent from the data driver 300. That is, the gamma block 310 may be implemented as a separate component outside of the data driver 300.

As will be discussed in more detail below with reference to FIG. 2, the driving block 320 may include a plurality of channel drivers (CD1 to CDm of FIG. 2). Each of the plurality of channel drivers may receive a gamma voltage set from one of the plurality of gamma voltage generators GMG1 to GMG3 and may generate an image signal supplied to a corresponding data line of the data lines DL1 to DLm, based on the received gamma voltage set.

In the display apparatus 1000 according to an exemplary embodiment, the number of enabled gamma voltage generators among the plurality of gamma voltage generators GMG1 to GMG3 may vary based on operation modes of the display apparatus (or a display driving circuit) 1000.

In an exemplary embodiment, when the display apparatus 1000 operates in a first operation mode, the plurality of gamma voltage generators GMG1 to GMG3 and the plurality of channel drivers may be enabled, and each of the plurality of channel drivers may generate an image signal, based on a gamma voltage set supplied from a corresponding gamma voltage generator of the plurality of gamma voltage generators GMG1 to GMG3 and may supply the generated image signal to a corresponding data line. For example, the first operation mode may be a normal mode, a high performance mode, and/or a high frequency mode.

When the display apparatus 1000 operates in a second operation mode, at least one but not all of the plurality of gamma voltage generators GMG1 to GMG3 may be disabled (turned off), and at least one channel driver corresponding to the disabled gamma voltage generator(s) may also be disabled. An enabled channel driver may receive a gamma voltage set from a corresponding gamma voltage generator and may generate an image signal, based on the received gamma voltage set. At this time, instead of the disabled channel driver, the enabled channel driver may drive a data line which is driven by the disabled channel driver in the first operation mode. The enabled channel driver may time-divisionally drive a plurality of data lines during one horizontal driving period. The second operation mode may be a low power mode, an always-on display (AOD) mode, and/or a low frequency mode. A frame frequency of the second operation mode may be relatively lower than that of the first operation mode. Hereinafter, for convenience of description, the first operation mode may be referred to as a normal mode, and the second operation mode may be referred to as a low power mode.

The gamma block 310 and the driving block 320, as described above, may operate an operation mode of the display apparatus 1000 in response to a mode control signal MCTRL supplied from control logic 500.

The timing controller 200 may control all operations of the display apparatus 1000. The timing controller 200 may receive image data IDATA and display control signals (for example, a horizontal synchronization signal Hsync, a vertical synchronization signal Vsync, a clock signal MCLK, and a data enable signal DE) from an external device (for example, an application processor, an image processor, a central processing unit (CPU), and/or the like of an electronic device equipped with the display apparatus 1000) that is external to the display apparatus 1000 and may generate the data driver control signal DCTRL and the gate driver control signal GCTRL, based on the received display control signals. However, the present exemplary embodiment is not limited thereto, the timing controller 200 may also generate other control signals.

Moreover, the timing controller 200 may convert a format of the image data IDATA received from the outside according to an interface specification with the data driver 300 or may convert the image data IDATA through data processing and may transfer image data RGB obtained through the conversion to the data driver 300. The image data RGB (or IDATA) may include pixel data for at least one horizontal line. In an exemplary embodiment, the image data RGB may include packet data.

In the present exemplary embodiment, the timing controller 200 may determine an operation mode of the display apparatus 1000 (or the display driving circuit 600) and may generate a mode signal (MD) based on the determined operation mode. For example, the timing controller 200 may make a determination which allows the display apparatus 1000 to operate in the low power mode, in response to a low power mode request signal received from the outside. Alternatively, the timing controller 200 may analyze the received image data IDATA and may determine whether to enter the low power mode of the display apparatus 1000, based on a result of the analysis. For example, if the received image data IDATA corresponds to a still image or the image data IDATA is not received from the outside for a certain time, the timing controller 200 may make a determination which allows the display apparatus 1000 to enter the low power mode.

When the display apparatus 1000 operates in the low power mode, the timing controller 200 may lower a frame frequency of the display apparatus 1000. In other words, the timing controller 200 may set a frame frequency of the low power mode to lower than that of a frame frequency of the normal mode.

The control logic 500 may control the gamma block 310 and the driving block 320 of the data driver 300 according to the operation mode. The control logic 500 may control outputs of the gamma block 310 and the drive block 320. In an exemplary embodiment, the control logic 500 may receive the mode signal MD from the timing controller 200 and control the gamma block 310 and drive block 320 of the data driver 300 based on the mode signal MD. The control logic 500 may generate the mode control signal MCTRL which includes enable signals respectively corresponding to the plurality of gamma voltage generators GMG1 to GMG3, enable signals respectively corresponding to the plurality of channel drivers, and an output control signal for controlling an output of each of the plurality of channel drivers. The control logic 500 may generate a mode control signal MCTRL based on the operation mode and the frame frequency. In an exemplary embodiment, the control logic 500 may be included in the timing controller 200. In another exemplary embodiment the control logic 500 may be included in the data driver 300.

As a resolution and a function of the display apparatus 1000 are enhanced, the consumption power of the display driving circuit 600 increases. Accordingly, it is advantageous to have a method of decreasing the consumption power of the display driving circuit 600.

The display apparatus 1000 according to the present exemplary embodiment may operate in the low power mode. In the low power mode, a frame frequency of the display apparatus 1000 may be set to be lower than the frame frequency of the normal mode, and one or more but not all of the plurality of channel drivers included in the driving block 320 may be disabled (turned off), thereby decreasing the consumption power of the driving block 320. Also, at least one but not all of the plurality of gamma voltage generators GMG1 to GMG3 included in the gamma block 310 may be disabled, and thus, the consumption power of the gamma block 310 is reduced. As described above, the display apparatus 1000 according to the present exemplary embodiment may decrease the consumption power of the gamma block 310 as well as the driving block 320, thereby minimizing consumption power.

The display apparatus 1000 according to the present exemplary embodiment may be equipped in various kinds of electronic devices including an image display function. For example, the electronic devices may include a smartphone, a tablet personal computer (PC), a mobile phone, an E-book reader, a desktop PC, a laptop PC, a personal digital assistant (PDA), a portable multimedia player (PMP), an MPEG audio player-3 (MP3) player, a medical device, a, or a wearable device, but are not limited thereto.

Figure 2:
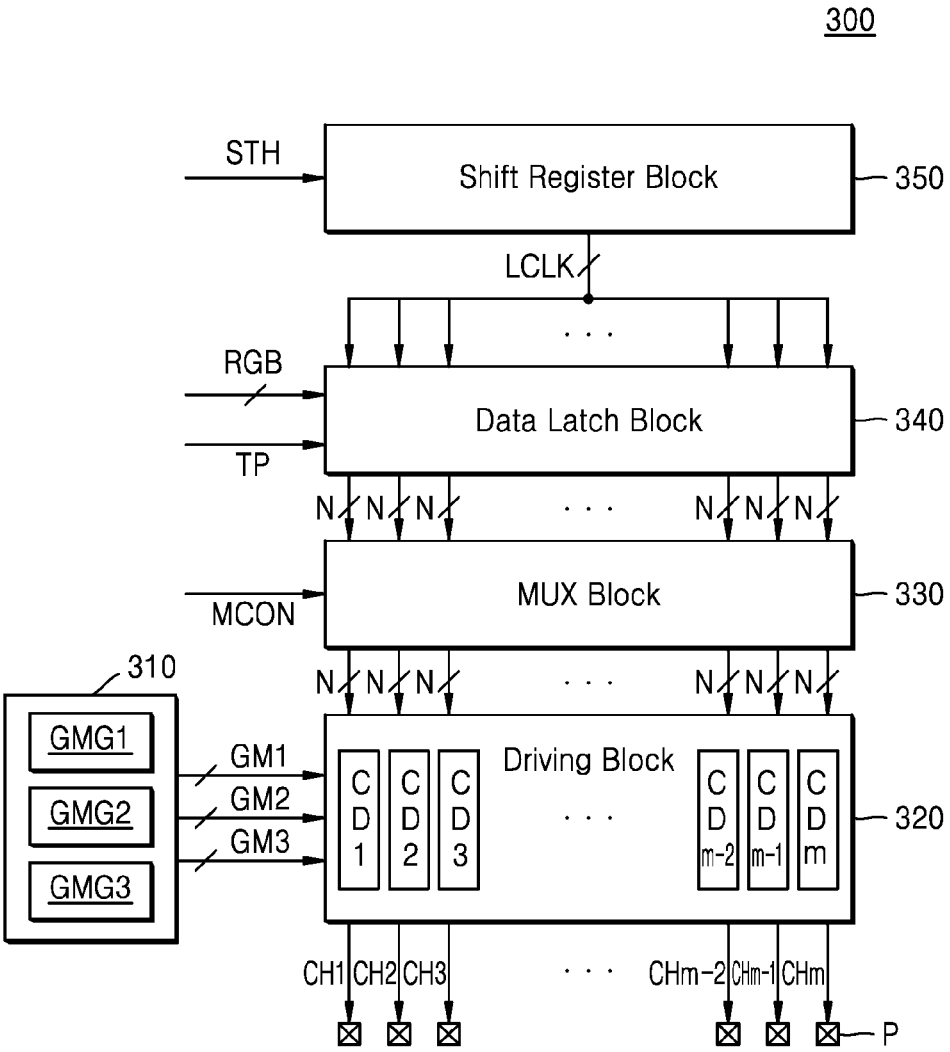
FIG. 2 is a block diagram schematically illustrating a data driver according to an exemplary embodiment.

FIG. 2 is a block diagram schematically illustrating the data driver 300 according to an exemplary embodiment.

Referring to FIG. 2, the data driver 300 may include the gamma block 310, the driving block 320, a multiplexing (MUX) block 330, a data latch block 340, and a shift register block 350. As described above, the data driver 300 may further include a control logic.

The shift register block 350 may control a timing when pieces of image data RGB are sequentially stored in the data latch block 340. The shift register block 350 may sequentially shift a vertical synchronization start signal STH to generate shifted clock signals (for example, latch clock signals LCLK shown in FIG. 2) and may supply the latch clock signals LCLK to the data latch block 340.

The data latch block 340 may be configured as a plurality of latch circuits and may sequentially store image data RGB, corresponding to one horizontal line, from one end to another end of a latch circuit, based on the latch clock signals LCLK output from the shift register block 350. When the pieces of image data RGB are completely stored, the data latch block 340 may output the image data RGB in response to a load signal TP. The image data RGB corresponding to the one horizontal line may include a plurality of pieces of pixel data each consisting of N bits, and the data latch block 340 may output the plurality of pieces of pixel data.

The multiplexing (MUX) block 330 may multiplex the plurality of pixel data output from the data latch block 340, based on a multiplexing control signal MCON. For example, in the normal mode, the multiplexing block 330 may provide m pieces of pixel data to m channel drivers CD1 to CDm during one horizontal driving period. The multiplexing block 330 may provide m pieces of pixel data to a corresponding channel drivers among the m channel drivers CD1 to CDm during one horizontal driving period. In the low power mode, the multiplexing block 330 may sequentially supply the plurality of pixel data to an enabled channel driver during one horizontal driving period.

The gamma block 310 may include the plurality of gamma voltage generators GMG1 to GMG3. An output of each of the plurality of gamma voltage generators GMG1 to GMG3 may be supplied to corresponding channel drivers of the plurality of channel drivers CD1 to CDm of the driving block 320. For example, an output (i.e., a first gamma voltage set GM1) of a first gamma voltage generator GMG1 may be supplied to a (3*K)−2th channel driver (e.g., channel driver CDm−2), an output (i.e., a second gamma voltage set GM2) of a second gamma voltage generator GMG2 may be supplied to (3*K)−1th channel driver (e.g., channel driver CDm−1), and an output (i.e., a third gamma voltage set GM3) of a third gamma voltage generator GMG3 may be supplied to a (3*K)th channel driver (e.g., channel driver CMm). (See also FIG. 3) Here, K may be an integer, and 3*K may be the same as m.

The driving block 320 may include the plurality of channel drivers CD1 to CDm. Each of the plurality of channel drivers CD1 to CDm may receive a gamma voltage set and pixel data and may select one gamma voltage corresponding to the pixel data from among a plurality of gamma voltages included in the gamma voltage set to generate an image signal. Each of the plurality of channel drivers CD1 to CDm may output the image signal through a corresponding channel of a plurality of channels CH1 to CHm. The plurality of channels CH1 to CHm may be electrically connected to the data lines (DL1 to DLm of FIG. 1) of the display panel through a plurality of output pads P, respectively.

As described above with reference to FIG. 1, in the low power mode, at least one of the plurality of gamma voltage generators GMG1 to GMG3 may be disabled, and some of the plurality of channel drivers CD1 to CDm may be disabled. An enabled channel driver may generate a plurality of image signals during one horizontal driving period and may sequentially supply the plurality of image signals to a plurality of channels. At this time, in order for the enabled channel driver to generate the plurality of image signals, the multiplexing (MUX) block 330 may sequentially supply a plurality of pixel data to the enabled channel driver through a multiplexing operation.

For example, in the low power mode, the second gamma voltage generator GMG2 and the third gamma voltage generator GMG3 may be disabled, and the (3*K)−1th channel driver and the (3*K)th channel driver which respectively receive gamma voltage sets from the second gamma voltage generator GMG2 and the third gamma voltage generator GMG3 to operate may be disabled. The (3*K)−2th channel driver may supply an image signal to a (3*K)−2th channel, a (3*K)−1th channel, and a (3*K)th channel. The (3*K)−2th channel driver (for example, a first channel driver CD1 in the case that K=1) may receive the first gamma voltage set GM1 from the first gamma voltage generator GMG1, and moreover, may sequentially receive (3*K)−2th pixel data, (3*K)−1th pixel data, and (3*K)th pixel data (for example, first to third pixel data in the case that K=1) from the multiplexing (MUX) block 330. The (3*K)−2th channel driver may sequentially generate image signals respectively corresponding to the (3*K)−2th pixel data, the (3*K)−1th pixel data, and the (3*K)th pixel data, based on the first gamma voltage generator GMG1 and may supply the generated image signals to the (3*K)−2th channel, the (3*K)−1th channel, and the (3*K)th channel.

Figure 3:
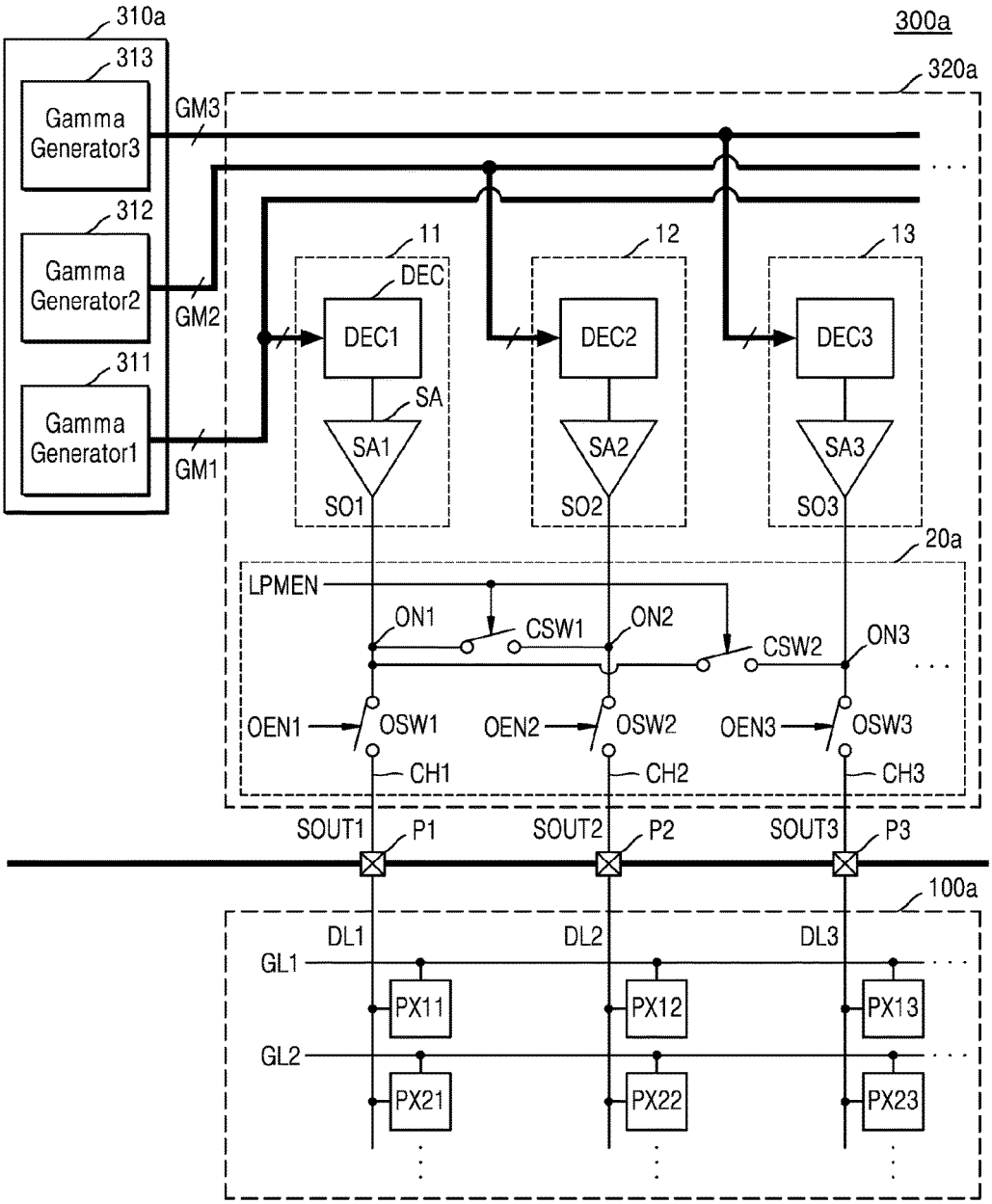
FIG. 3 is a circuit diagram illustrating a data driver according to an exemplary embodiment.

FIG. 3 is a circuit diagram illustrating a data driver 300*a* according to an exemplary embodiment. For convenience of description, a display panel 100*a* is illustrated together with the data driver 300*a*, and elements other than a gamma block 310*a* and a driving block 320*a* are omitted.

Referring to FIG. 3, the gamma block 310*a* may include first to third gamma voltage generators 311 to 313. The first gamma voltage generator 311 may output a first gamma voltage set GM1, the second gamma voltage generator 312 may output a second gamma voltage set GM2, and the third gamma voltage generator 313 may output a third gamma voltage set GM3. In this case, the first to third gamma voltage sets GM1 to GM3 may merely denote respective outputs of the first to third gamma voltage generators 311 to 313, namely, respective gamma voltage sets output from the first to third gamma voltage generators 311 to 313, and may not denote that each of the first to third gamma voltage sets GM1 to GM3 corresponds to a certain color. The first to third gamma voltage sets GM1 to GM3 may each include a plurality of gamma voltages. During one horizontal driving period, the first to third gamma voltage sets GM1 to GM3 may correspond to different colors.

The driving block 320*a* may include a plurality of channel drivers 11 to 13 and an output control circuit 20*a*. The driving block 320*a* may include a plurality of channel drivers respectively corresponding to the first to third gamma voltage generators 311 to 313. In FIG. 3, for convenience of description, one channel driver (i.e., of the first to third channel drivers 11 to 13) corresponding to one of the first to third gamma voltage generators 311 to 313 is illustrated. That is, in the example of FIG. 3, the channel drivers 11-13 and the first to third gamma voltage generators 311-313 are provided in a one-to-one relationship.

Each of the plurality of channel drivers 11 to 13 may include a decoder DEC and a channel amplifier SA. The decoder DEC may receive a gamma voltage set and pixel data and may select a gamma voltage corresponding to the pixel data from among a plurality of gamma voltages included in the gamma voltage set.

The channel amplifier SA may output the selected gamma voltage as an image signal. The channel amplifier SA may be implemented with a differential amplifier. The channel amplifier SA may operate as a buffer that amplifies and outputs a current of an input signal. The channel amplifier SA may determine whether to operate, in response to a received enable signal (not shown). For example, when the enable signal has a first level (e.g., a logic high level), the channel amplifier SA may operate, and when the enable signal has a second level (e.g., a logic low level), the channel amplifier SA may be disabled.

The output control circuit 20*a* may control outputs of the plurality of channel drivers 11 to 13, namely, paths through which a plurality of channel amplifier outputs SO1 to SO3 are respectively supplied to a plurality of channels CH1 to CH3. The output control circuit 20*a* may include a plurality of output switches OSW1 to OSW3 and a plurality of connection switches CSW1 and CSW2. The plurality of output switches OSW1 to OSW3 may be turned on or off in response to output enable signals OEN1 to OEN3, and the connection switches CSW1 and CSW2 may be turned on or off in response to a low power enable signal LPMEN. The output switches OSW1 to OSW3 may be turned on and may electrically connect a plurality of output nodes ON1 to ON3 to the plurality of channels CH1 to CH3, respectively. The connection switches CSW1 and CSW2 may be turned on and may electrically connect a first output node ON1 to a second output node ON2 and to a third output node ON3.

The plurality of channels CH1 to CH3 may be connected to a plurality of data lines DL1 to DL3 of the display panel 100*a* through a plurality of pads P1 to P3, respectively. Therefore, a plurality of output signals SOUT1 to SOUT3 output through the plurality of channels CH1 to CH3 may be supplied to the plurality of data lines DL1 to DL3, respectively.

An operation of the data driver 300*a* of FIG. 3 will be described in detail with reference to FIGS. 4 to 6C.

Figure 4:
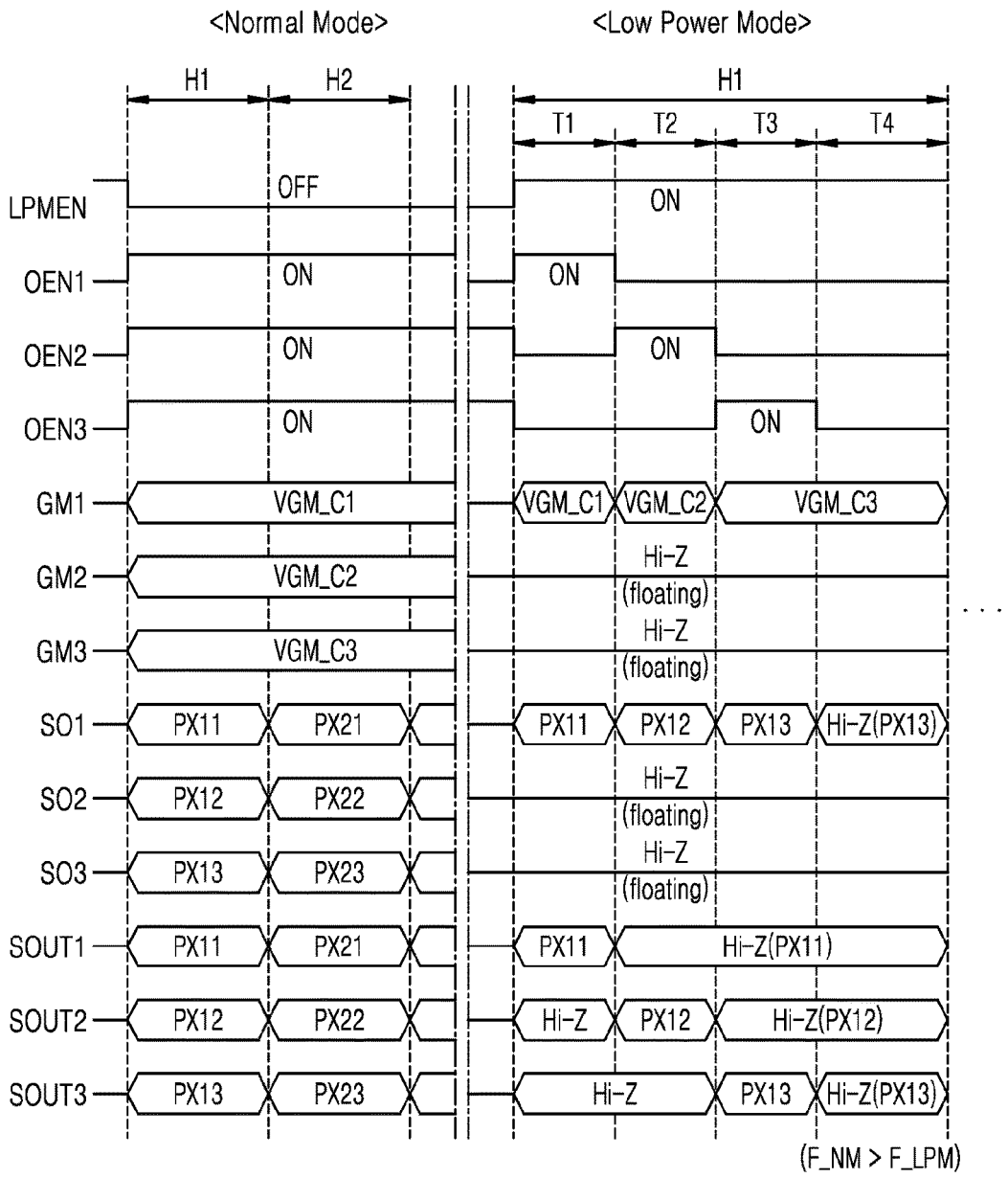
FIG. 4 is a timing diagram showing signals of the data driver of FIG. 3 based on an operation mode.
Figure 5:
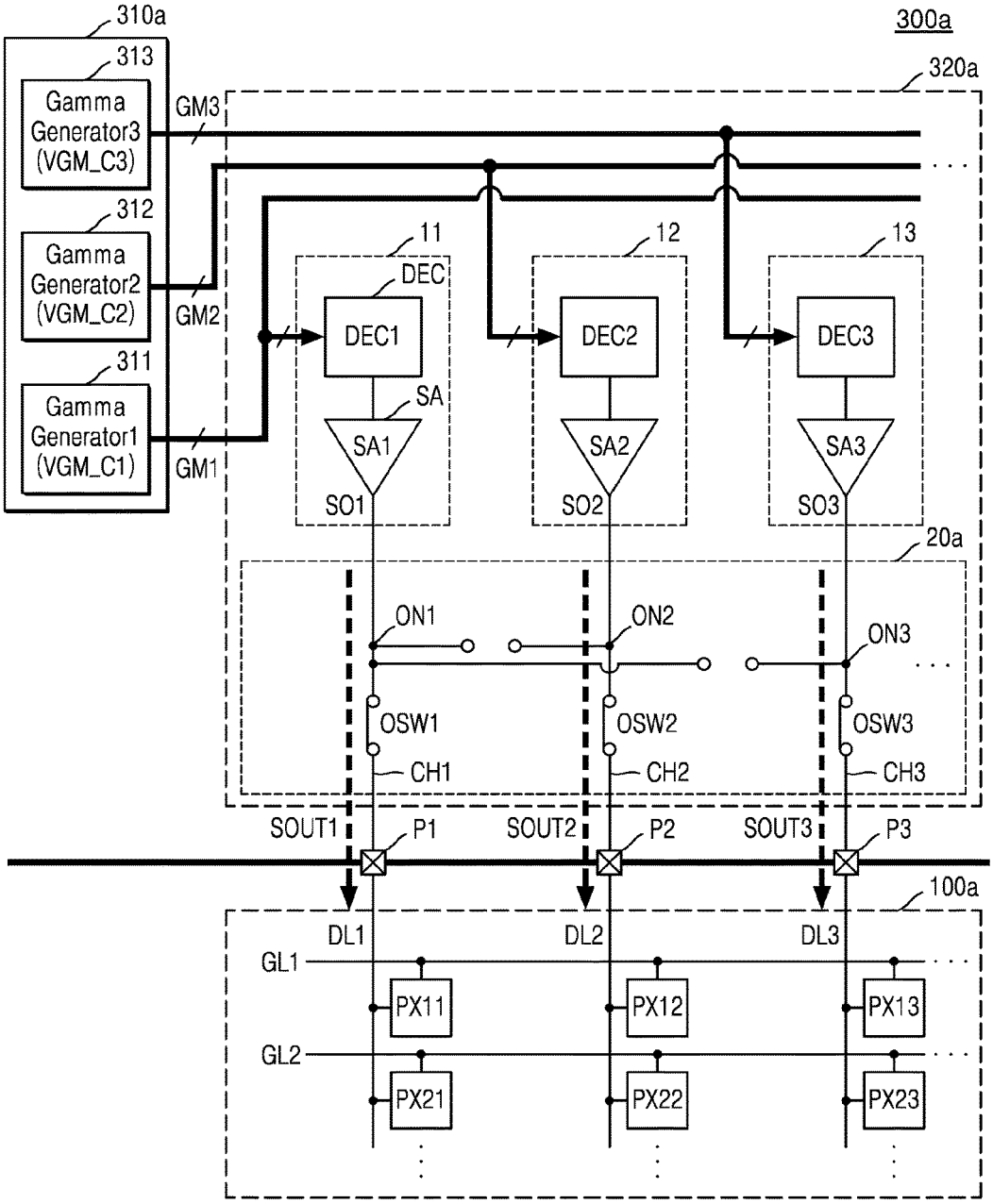
FIG. 5 illustrates an operation of the data driver of FIG. 3 in a normal mode.
Figure 6A:
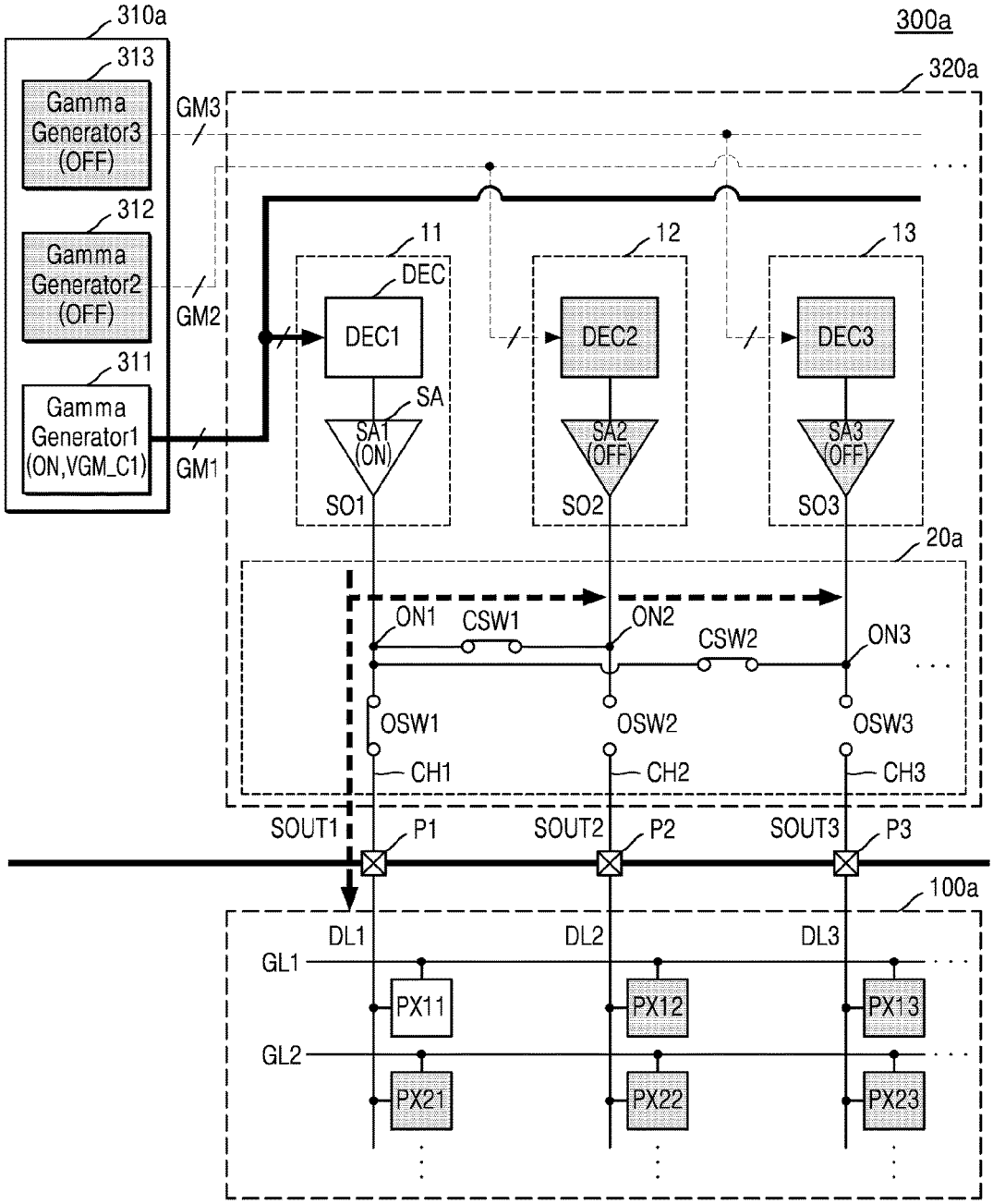
FIGS. 6A to 6C illustrate an operation of the data driver of FIG. 3 in a low power mode.
Figure 6B:
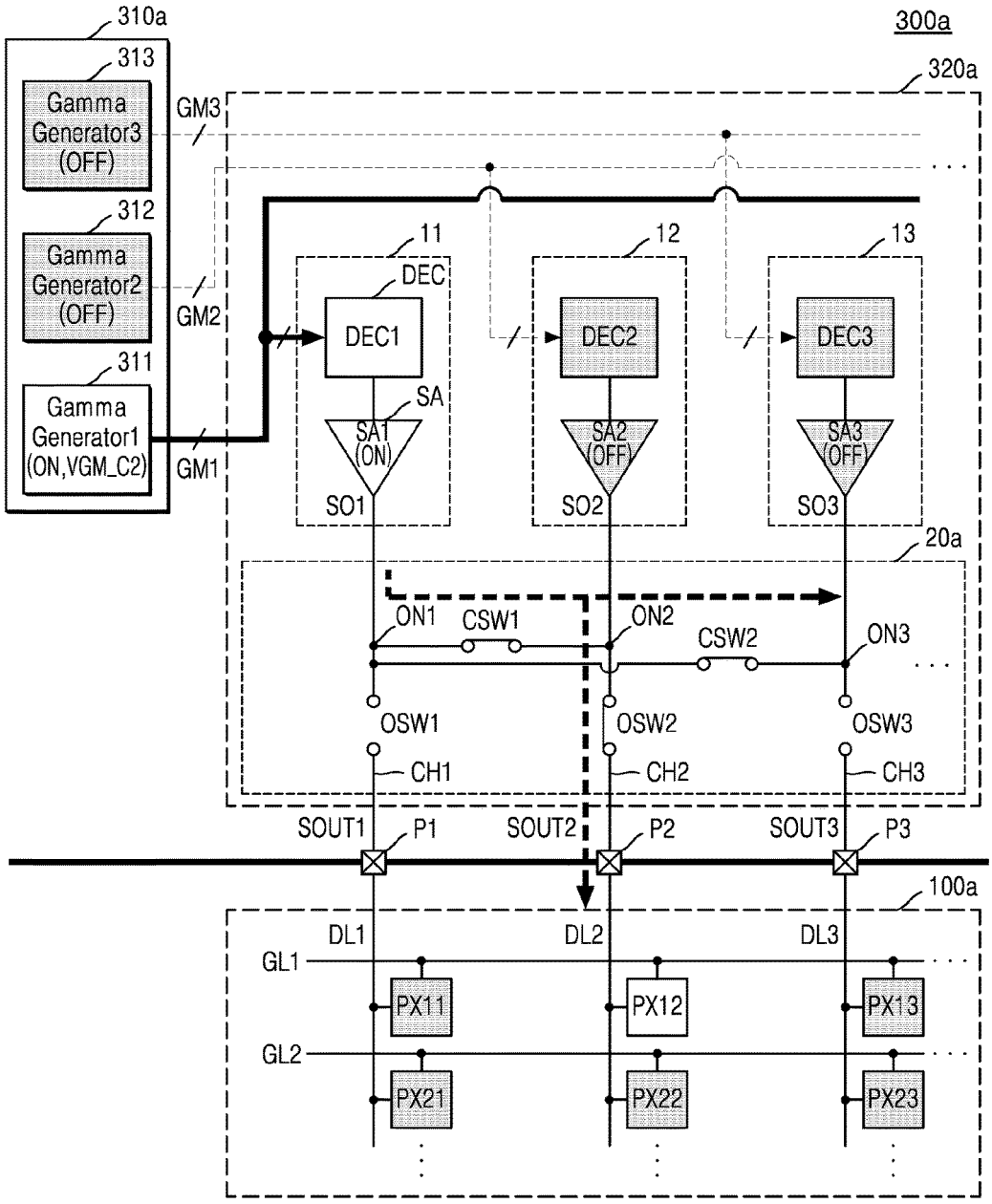
Figure 6C:
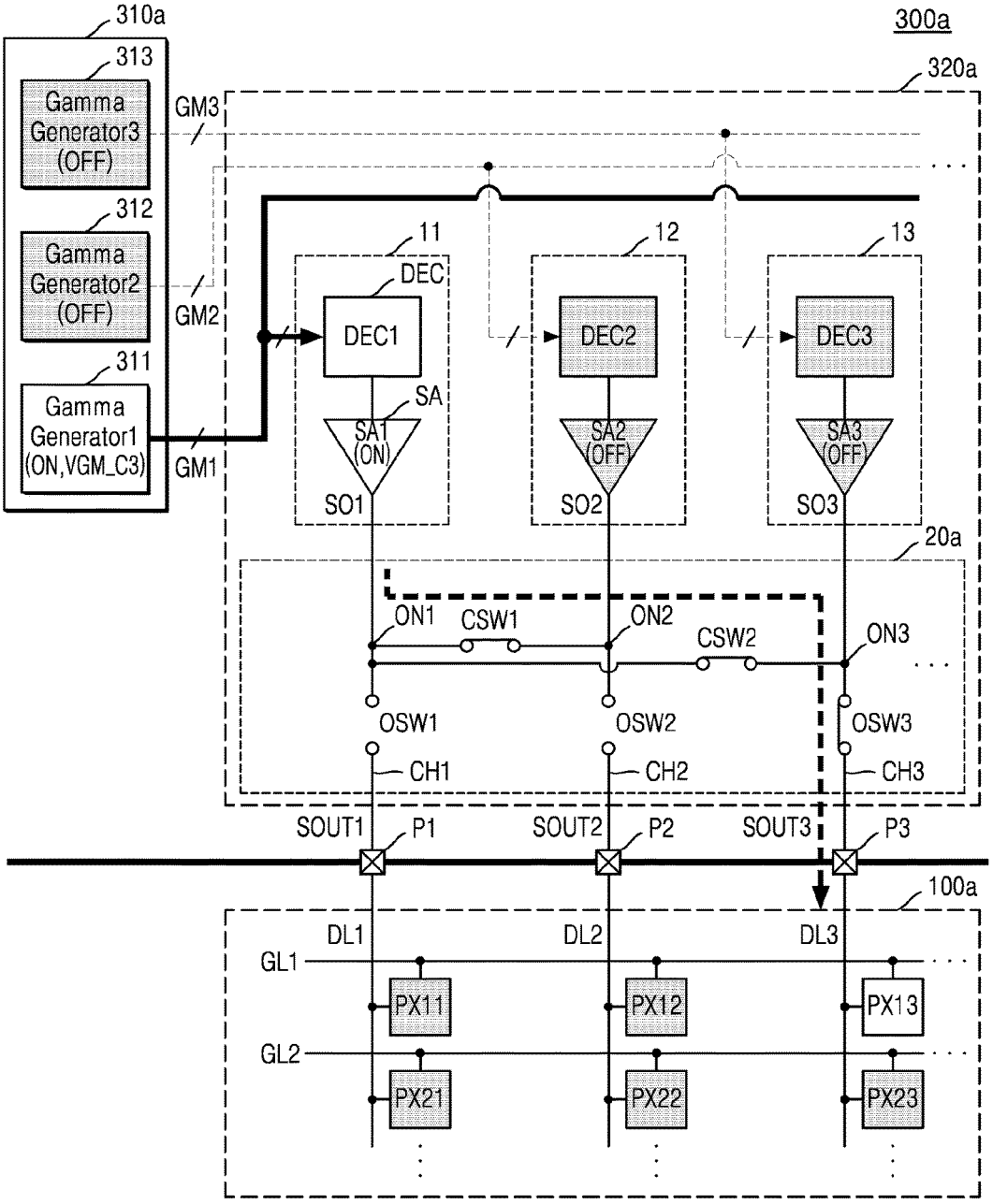

FIG. 4 is a timing diagram showing signals of the data driver 300*a* of FIG. 3 based on an operation mode. FIG. 5 illustrates an operation of the data driver 300*a* of FIG. 3 in a normal mode. FIGS. 6A to 6C illustrate an operation of the data driver 300*a* of FIG. 3 in a low power mode.

Referring to FIGS. 4 and 5, in the normal mode, the first to third gamma voltage generators 311 to 313 may be enabled, and the first to third channel drivers 11 to 13 may be enabled. The first gamma voltage generator 311 may generate a first color gamma voltage set VGM_C1 as the first gamma voltage set GM1, the second gamma voltage generator 312 may generate a second color gamma voltage set VGM_C2 as the second gamma voltage set GM2, and the third gamma voltage generator 313 may generate a third color gamma voltage set VGM_C3 as the third gamma voltage set GM3. For example, a first color may be a color corresponding to first pixels PX11 and PX21 connected to a first data line DL1, a second color may be a color corresponding to second pixels PX12 and PX22 connected to a second data line DL2, and a third color may be a color corresponding to third pixels PX13 and PX23 connected to a third data line DL3.

Each of the first to third channel drivers 11 to 13 may generate an image signal, based on a corresponding gamma voltage set of the first to third gamma voltage sets GM1 to GM3 in the normal mode. Therefore, during a first horizontal driving period H1 in the normal mode, image signals corresponding to pixels PX11 to PX13 of a first line may be respectively output as first to third channel amplifier outputs SO1 to SO3, and during a second horizontal driving period H2 in the normal mode, image signals corresponding to pixels PX21 to PX23 of a second line may be respectively output as the first to third channel amplifier outputs SO1 to SO3.

The low power enable signal LPMEN may be at a logic low level, and the output enable signals OEN1 to OEN3 may be at a logic high level. Therefore, the connection switches CSW1 and CSW2 may be turned off, and the output switches OSW1 to OSW3 may be turned on. Therefore, the first to third channel amplifier outputs SO1 to SO3 may be supplied to the first to third data lines DL1 to DL3 as first to third output signals SOUT1 to SOUT3, respectively.

Hereinafter, an operation of the data driver 300*a* in the low power mode will be described. A frame frequency F_LPM of the low power mode may be set relatively lower than a frame frequency F_NM of the normal mode. Therefore, a length of one horizontal driving period in the low power mode may be longer than that of one horizontal driving period in the normal mode. First to third periods T1 to T3 of first to fourth periods T1 to T4 included in one horizontal driving period may each be a data charging period, and the fourth period T4 may be a data holding period.

Referring to FIGS. 4 and 6A to 6C, in the low power mode, the first gamma voltage generator 311 may be enabled, and the second gamma voltage generator 312 and the third gamma voltage generator 313 may be disabled (indicated by shaded out boxes in FIG. 6A). Also, the first channel driver 11 corresponding to the first gamma voltage generator 311 may be enabled, and the second and third channel drivers 12 and 13 corresponding to the second and third gamma voltage generators 312 and 313 may be disabled (indicated by shaded out boxes in FIG. 6A). Outputs GM2 and GM3 of the second and third gamma voltage generators 312 and 313 and the second and third channel amplifier outputs SO2 and SO3 may be floated (for example, a high impedance state).

During one horizontal driving period, the first channel driver 11 may sequentially generate three image signals and may respectively supply the generated image signals to the first to third data lines DL1 to DL3. For example, as illustrated, during the first to third periods T1 to T3 of the first horizontal driving period H1 in the low power mode, the first channel driver 11 may sequentially generate image signals corresponding to the three pixels PX11 to PX13 of the first line.

To this end, the first gamma voltage generator 311 may generate the first color gamma voltage set VGM_C1 corresponding to a first pixel PX11 during the first period T1, generate the second color gamma voltage set VGM_C2 corresponding to a second pixel PX12 during the second period T2, and generate the third color gamma voltage set VGM_C3 corresponding to a third pixel PX13 during the third period T3.

Based on an output (i.e., the first gamma voltage set GM1) of the first gamma voltage generator 311, the first channel driver 11 may generate an image signal corresponding to the first pixel PX11 during the first period T1 of the first horizontal driving period H1 in the low power mode, generate an image signal corresponding to the second pixel PX12 during the second period T2, and generate an image signal corresponding to the third pixel PX13 during the third period T3. Therefore, during the first to third periods T1 to T3, image signals corresponding to the first to third pixels PX11 to PX13 may be sequentially output as the first channel amplifier output SO1.

In the low power mode, the low power enable signal LPMEN may be at a logic high level, and the first to third output enable signals OEN1 to OEN3 may be sequentially shifted to a logic high level. Therefore, the connection switches CSW1 and CSW2 may be turned on, and the output switches OSW1 to OSW3 may be sequentially turned on during the first to third periods T1 to T3.

As illustrated in FIGS. 6A to 6C, the first channel amplifier output SO1 may be sequentially output as the first to third output signals SOUT1 to SOUT3. Therefore, as illustrated in FIG. 6A, during the first period T1, the first channel driver 11 may generate an image signal corresponding to the first pixel PX11 and may supply the image signal to the first data line DL1 through the first channel CH1. As illustrated in FIG. 6B, during the second period T2, the first channel driver 11 may generate an image signal corresponding to the second pixel PX12 and may supply the image signal to the second data line DL2 through the second channel CH2. Also, as illustrated in FIG. 6C, during the third period T3, the first channel driver 11 may generate an image signal corresponding to the third pixel PX13 and may supply the image signal to the third data line DL3 through the third channel CH3.

As described above, in the low power mode, at least one but not all of the plurality of gamma voltage generators 311 to 313 may be disabled, and one or more but not all of the plurality of channel drivers 11 to 13 may be disabled. Therefore, an enabled channel driver may sequentially generate a plurality of image signals, based on a gamma voltage set output by an enabled gamma voltage generator. Also, based on an operation of the output control circuit 20*a*, an output of the enabled channel driver may be sequentially supplied to a plurality of channels. Therefore, in the low power mode, the enabled gamma voltage generator may time-divisionally generate a gamma voltage set corresponding to a plurality of colors, and the enabled channel driver may time-divisionally drive a plurality of data lines, based on the generated gamma voltage set.

Figure 7A:
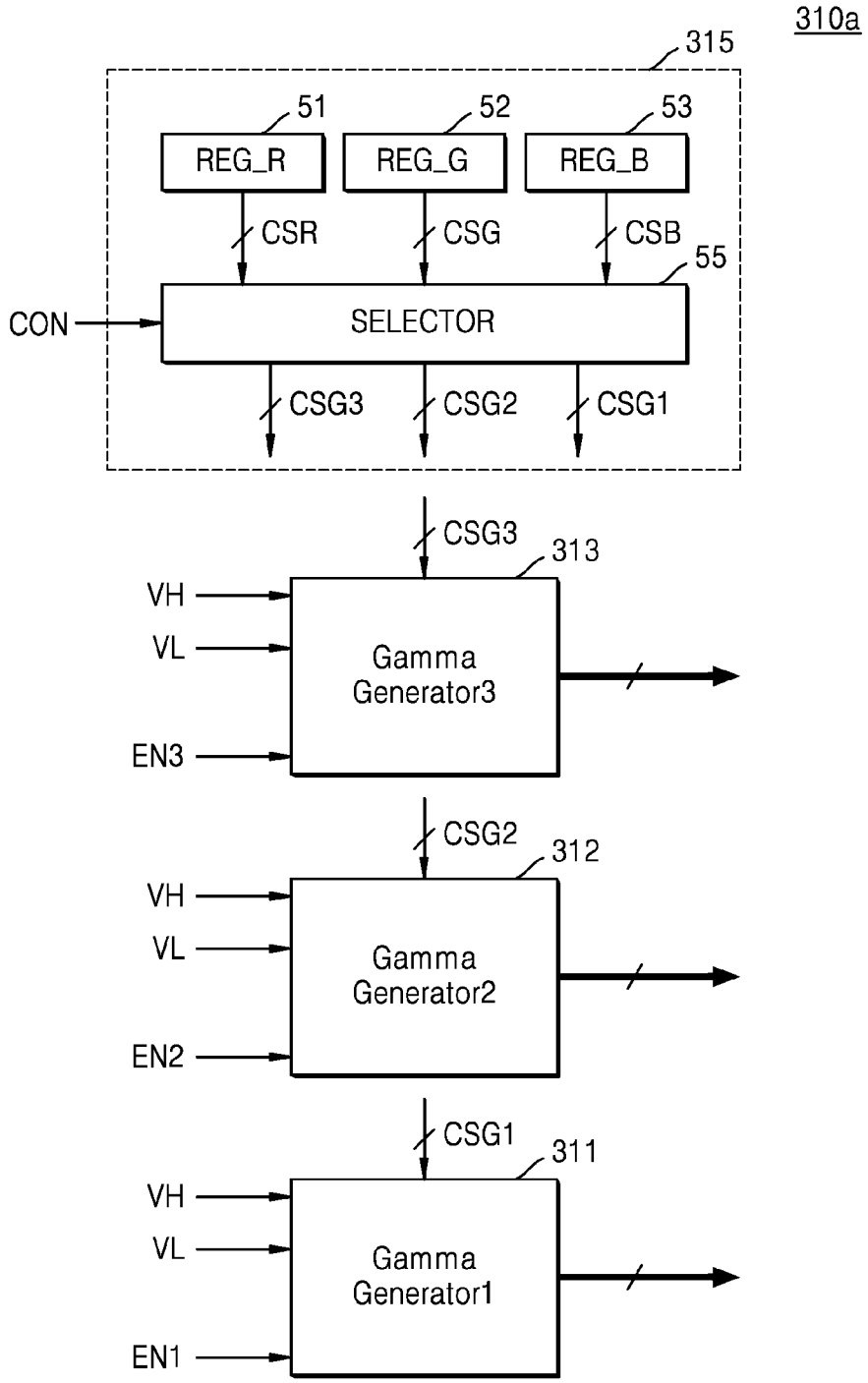
FIG. 7A illustrates an implementation example of a gamma block according to an exemplary embodiment.
Figure 7B:
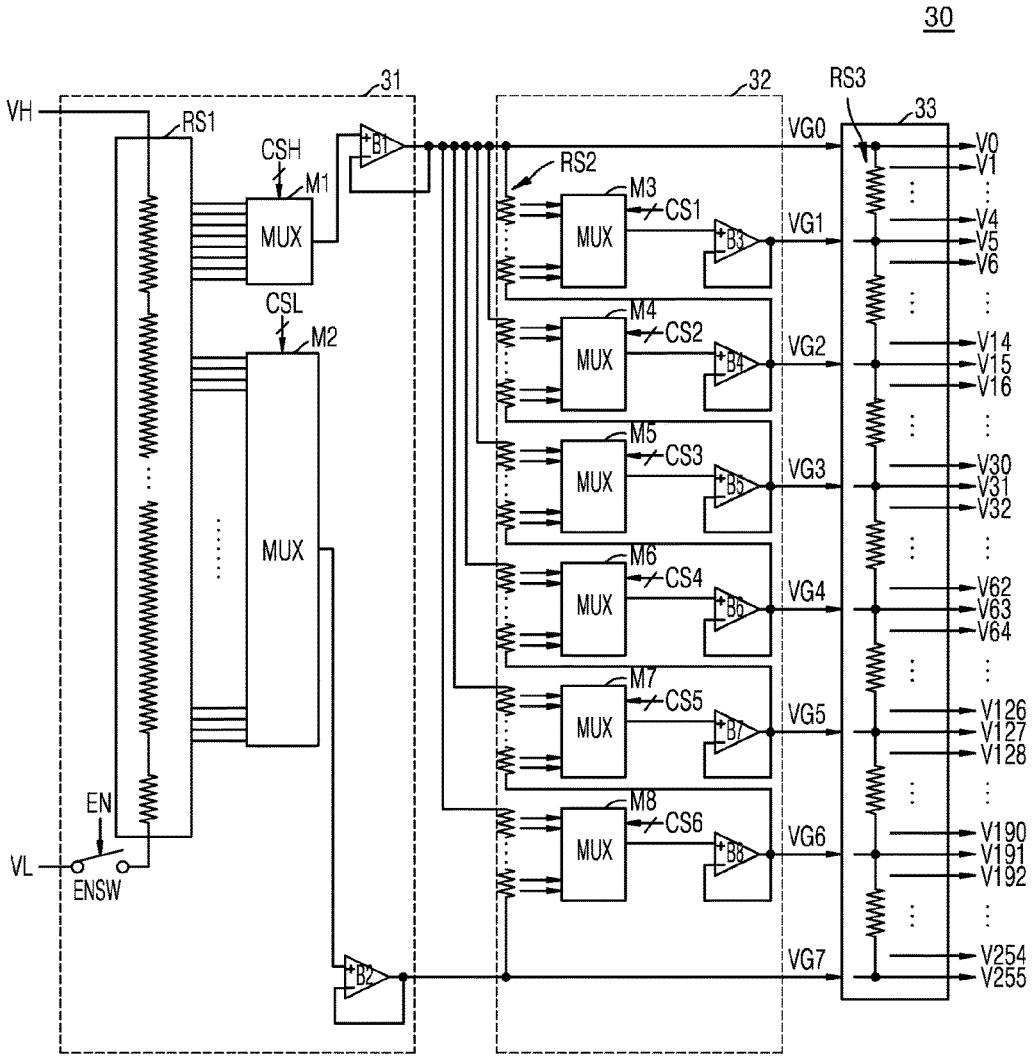
FIG. 7B illustrates an implementation example of a gamma voltage generator according to an exemplary embodiment.

FIG. 7A is a block diagram illustrating an implementation example of a gamma block 310*a* according to an exemplary embodiment, and FIG. 7B is a circuit diagram illustrating an implementation example of a gamma voltage generator 30 according to an exemplary embodiment.

Referring to FIG. 7A, the gamma block 310*a* may include a plurality of gamma voltage generators 311 to 313 and a register block 315. In FIG. 7A, the gamma block 310*a* is illustrated as including three gamma voltage generators 311 to 313, but this is an example. The number of gamma voltage generators may vary.

The register block 315 may include first to third registers 51 to 53 also denoted as REG_R, REG_G, and REG_B respectively. For example, the first register 51 may store a red selection signal CSR corresponding to red, the second register 52 may store a green selection signal CSG corresponding to green, and the third register 53 may store a blue selection signal CSB corresponding to blue.

The red selection signal CSR, the blue selection signal CSB, and the green selection signal CSG may be supplied to a selector 55. The selector 55 may be a multiplexer. The selector 55 may output one of the red selection signal CSR, the blue selection signal CSB, and the green selection signal CSG as each of a first selection signal CSG1, a second selection signal CSG2, and a third selection signal CSG3, based on a control signal CON. For example, in the normal mode, the selector 55 may respectively output the red selection signal CSR, the blue selection signal CSB, and the green selection signal CSG as the first selection signal CSG1, the second selection signal CSG2, and the third selection signal CSG3. In the low power mode, when only a first gamma voltage generator 311 is enabled, the selector 55 may sequentially select at least two of the red selection signal CSR, the blue selection signal CSB, and the green selection signal CSG and may supply each of the selected selection signals as the first selection signal CSG1 during one horizontal driving period. Each of the first selection signal CSG1, the second selection signal CSG2, and the third selection signal CSG3 may denote more than one selection signal. Each of the first selection signal CSG1, the second selection signal CSG2, and the third selection signal CSG3 may include a plurality of selection signals applied to the first gamma voltage generator 311, a second gamma voltage generator 312, and a third gamma voltage generator 313.

The first gamma voltage generator 311 may receive a first voltage VH, a second voltage VL, the first selection signal CSG1, and a first enable signal EN1 and may generate a gamma voltage set (i.e., a plurality of gamma voltages), based on the received signals. The first gamma voltage generator 311 may operate when the first enable signal EN1 is at a logic high level. The first gamma voltage generator 311 may voltage-divide the first voltage VH and the second voltage VL to generate a plurality of voltages, select gamma voltages based on the first selection signal CSG1, and output the selected gamma voltages as a first gamma voltage set.

The second gamma voltage generator 312 may receive the first voltage VH, the second voltage VL, the second selection signal CSG2, and a second enable signal EN2 and may generate a gamma voltage set, based on the received signals.

The third gamma voltage generator 313 may receive the first voltage VH, the second voltage VL, the third selection signal CSG3, and a third enable signal EN3 and may generate a gamma voltage set, based on the received signals. Operations of the second gamma voltage generator 312 and the third gamma voltage generator 313 are similar to that of the first gamma voltage generator 311, and thus, their detailed descriptions are not repeated.

The red selection signal CSR, the blue selection signal CSB, the green selection signal CSG may be supplied as RGB from the timing controller 200 as described above with reference to FIG. 1. The control signal CON and the first to third enable signals EN1 to EN3 may be supplied as part of the mode control signal MCTRL from the control logic 500.

A circuit of the gamma voltage generator 30 illustrated in FIG. 7B may be applied to the first to third gamma voltage generators 311 to 313.

Referring to FIG. 7B, the gamma voltage generator 30 may include a maximum-minimum selection circuit 31 including a first resistor string RS1, an intermediate gamma selection circuit 32 including a second resistor string RS2, and a gamma output circuit 33 including a third resistor string RS3. FIG. 7B exemplarily illustrates an example where the gamma voltage generator 30 generates 256 gamma voltages V0 to V255. However, the number of gamma voltages is not particularly limited.

The maximum-minimum selection circuit 31 may include the first resistor string RS1, a first selector M1, a second selector M2, a first buffer B1, and a second buffer B2. Also, the maximum-minimum selection circuit 31 may further include an enable switch ENSW. The first resistor string RS1 may voltage-divide the first voltage VH and the second voltage VL to generate a plurality of voltages. In this case, the level of the first voltage VH may be higher than that of the second voltage VL, and the second voltage VL may be, for example, a ground voltage. A plurality of voltages between the first voltage VH and the second voltage VL may be output through the first resistor string RS1, and the first selector M1 may select one of the plurality of voltages as a maximum intermediate gamma voltage VG0, based on a maximum selection signal CSH. The selected maximum intermediate gamma voltage VG0 may be buffered by the first buffer B1.

The second selector M2 may select one of the plurality of voltages as a minimum intermediate gamma voltage VG7, based on a minimum selection signal CSL. The selected minimum intermediate gamma voltage VG7 may be buffered by the second buffer B2.

The intermediate gamma selection circuit 32 may generate a plurality of intermediate gamma voltages VG1 to VG6, based on the maximum intermediate gamma voltage VG0 and the minimum intermediate gamma voltage VG7.

The intermediate gamma selection circuit 32 may include a plurality of second resistor strings RS2 and a plurality of selectors M3 to M8. The intermediate gamma selection circuit 32 may select one voltage from among a plurality of voltages generated through voltage division by each of the plurality of second resistor strings RS2 according to first to sixth selection signals CS1 to CS6 and may output the selected voltages as the plurality of intermediate gamma voltages VG1 to VG6. That is, for example, a first selection signal CS1 may select a voltage from a plurality of voltages and output the selected voltage as an intermediate gamma voltage VG1, and a second selection signal CS2 may select a voltage from a plurality of voltages and output the selected voltage as an intermediate gamma voltage VG2, etc. The intermediate gamma selection circuit 32 may further include a plurality of buffers B3 to B8, and the plurality of buffers B3 to B8 may respectively buffer the plurality of intermediate gamma voltages VG1 to VG6.

The gamma output circuit 33 may include the third resistor string RS3. By using the third resistor string RS3, the gamma output circuit 33 may perform voltage division between intermediate gamma voltages VG1 to VG7 to generate a plurality of gamma voltages V0 to V255.

The gamma voltage generator 30 may be enabled in response to an enable signal EN, and the enable switch ENSW may be turned on or off in response to the enable signal EN. When the enable signal EN is at a logic high level, the first voltage VH and the second voltage VL may be applied to the first resistor string RS1, and the buffers B1 to B8 may operate, whereby the gamma voltage generator 30 may be enabled. That is, the gamma voltage generator 30 may operate to generate the plurality of gamma voltages V0 to V255.

When the enable signal EN is at a logic low level, the first voltage VH and the second voltage VL may not be applied to the first resistor string RS1, and the buffers B1 to B8 may not operate, whereby the gamma voltage generator 30 may be disabled.

Hereinabove, the gamma block 310*a* and the gamma voltage generator 30 according to the present exemplary embodiment have been exemplarily described with reference to FIGS. 7A and 7B. However, this is merely an example, and the spirit of the present exemplary embodiment is not limited thereto. A structure of each of the gamma block 310*a* and the gamma voltage generator 30 may be variously modified.

Figure 8:
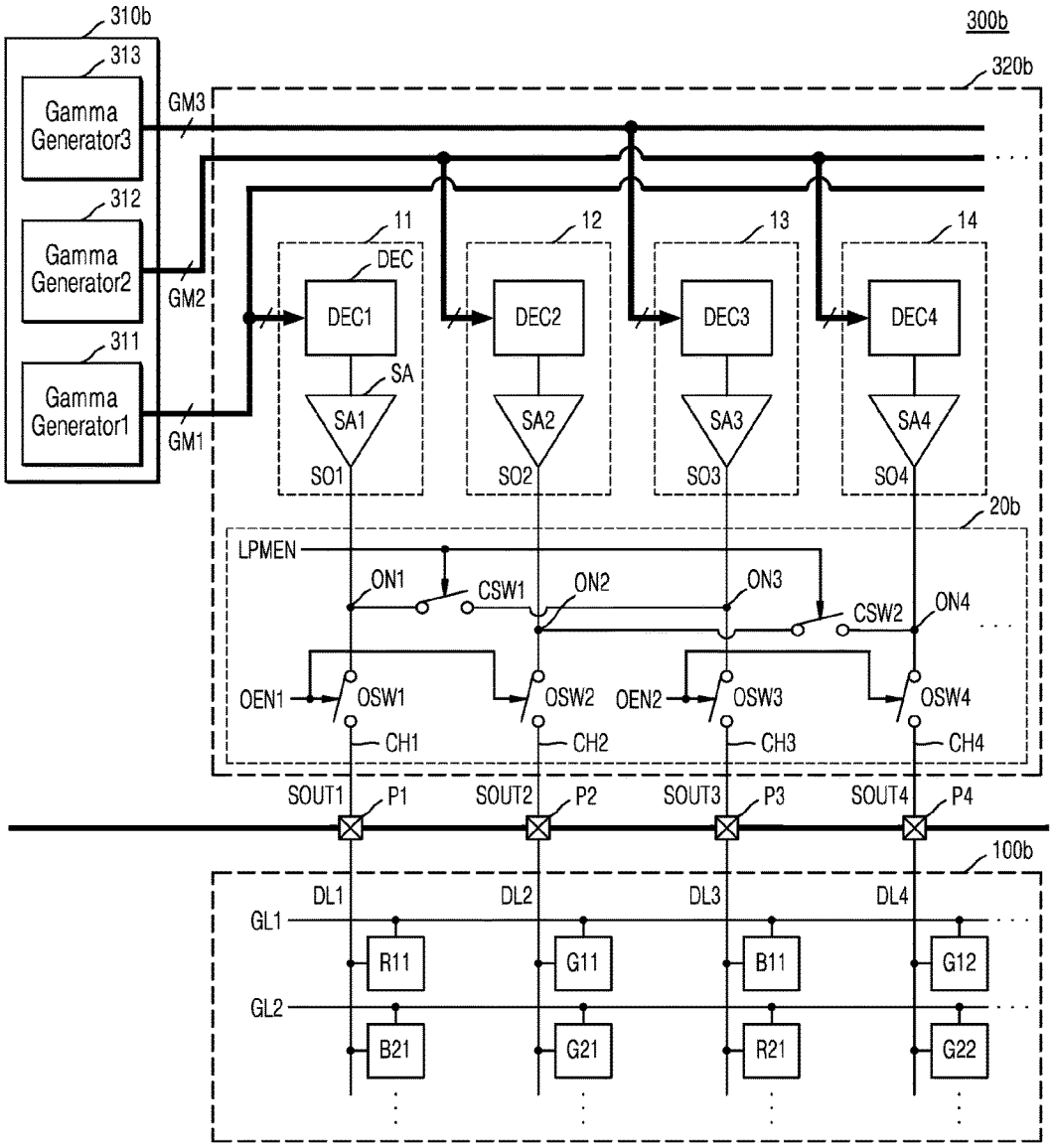
FIG. 8 is a circuit diagram illustrating a data driver according to an exemplary embodiment.

FIG. 8 is a circuit diagram illustrating a data driver 300*b* according to an exemplary embodiment. As illustrated, FIG. 8 illustrates one implementation example of the data driver 300*b* for driving a display panel 100*b* having a pentile structure where a red pixel, a first green pixel, a blue pixel, and a second green pixel are sequentially arranged.

Referring to FIG. 8, first to fourth data lines DL1 to DL4 respectively connected to the red pixel, the first green pixel, the blue pixel, and the second green pixel of the display panel 100*b* may be electrically connected to first to fourth channels CH1 to CH4, respectively. A driving block 320*b* may include first to fourth channel drivers 11 to 14 respectively corresponding to the first to fourth channels CH1 to CH4. The first channel driver 11 may receive an output (i.e., a first gamma voltage set GM1) of a first gamma voltage generator 311, and the second channel driver 12 and the fourth channel driver 14 may receive an output (i.e., a second gamma voltage set GM2) of a second gamma voltage generator 312, and a third channel driver 13 may receive an output (i.e., a third gamma voltage set GM3) of a third gamma voltage generator 313.

An output control circuit 20*b* may include a plurality of output switches OSW1 to OSW4 and a plurality of connection switches CSW1 and CSW2. The plurality of output switches OSW1 to OSW4 may be turned on or off in response to output enable signals OEN1 and OEN2, and the connection switches CSW1 and CSW2 may be turned on or off in response to a low power enable signal LPMEN. The output switches OSW1 to OSW4 may be turned on and may electrically connect a plurality of output nodes ON1 to ON4 to the plurality of channels CH1 to CH4, respectively. A first connection switch CSW1 may be turned on and may electrically connect a first output node ON1 to a third output node ON3, and a second connection switch CSW2 may be turned on and may electrically connect a second output node ON2 to a fourth output node ON4.

An operation of the data driver 300*b* of FIG. 8 will be described in detail with reference to FIGS. 9 to 11B.

Figure 9:
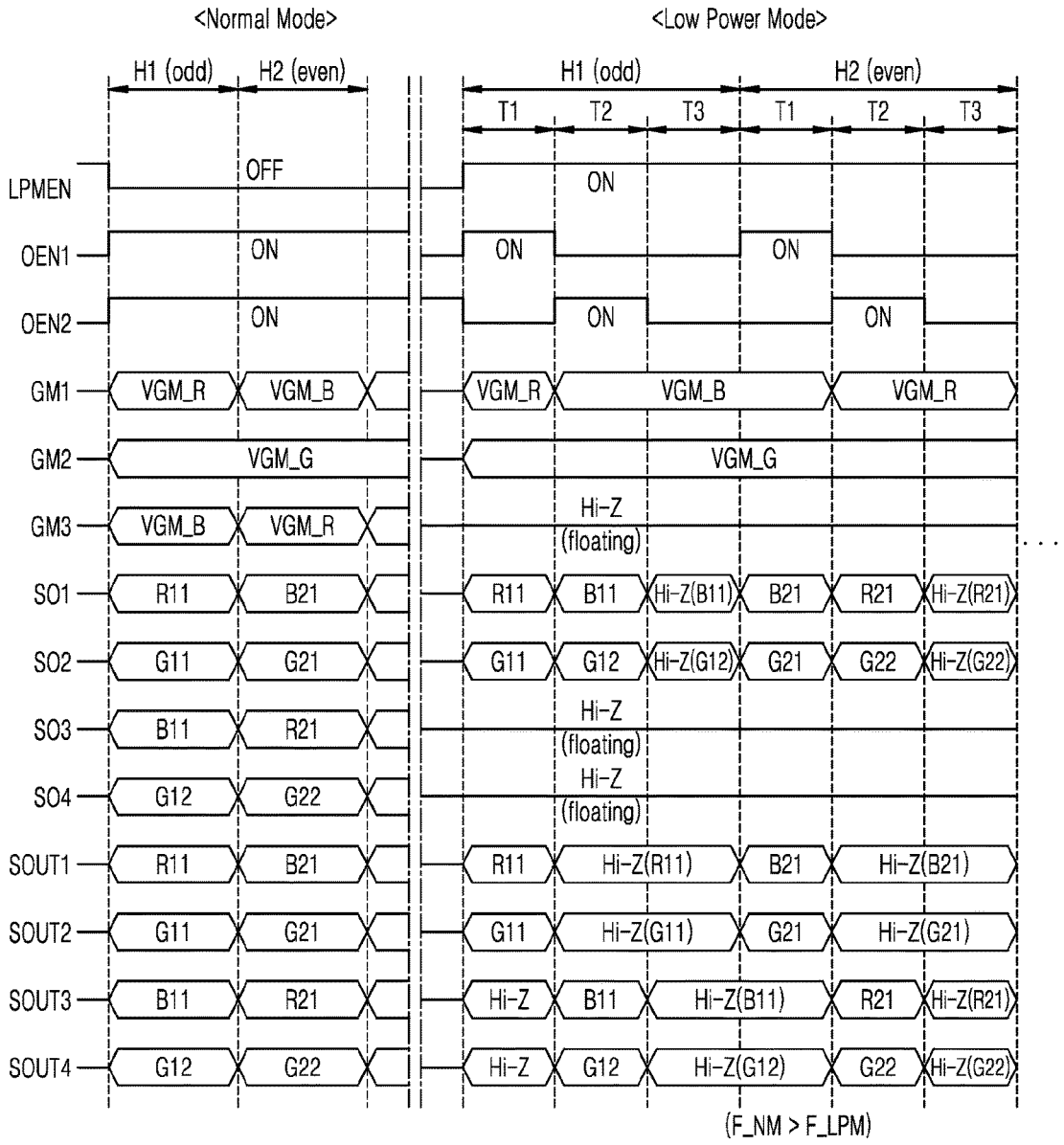
FIG. 9 is a timing diagram showing signals of the data driver of FIG. 8.
Figure 10:
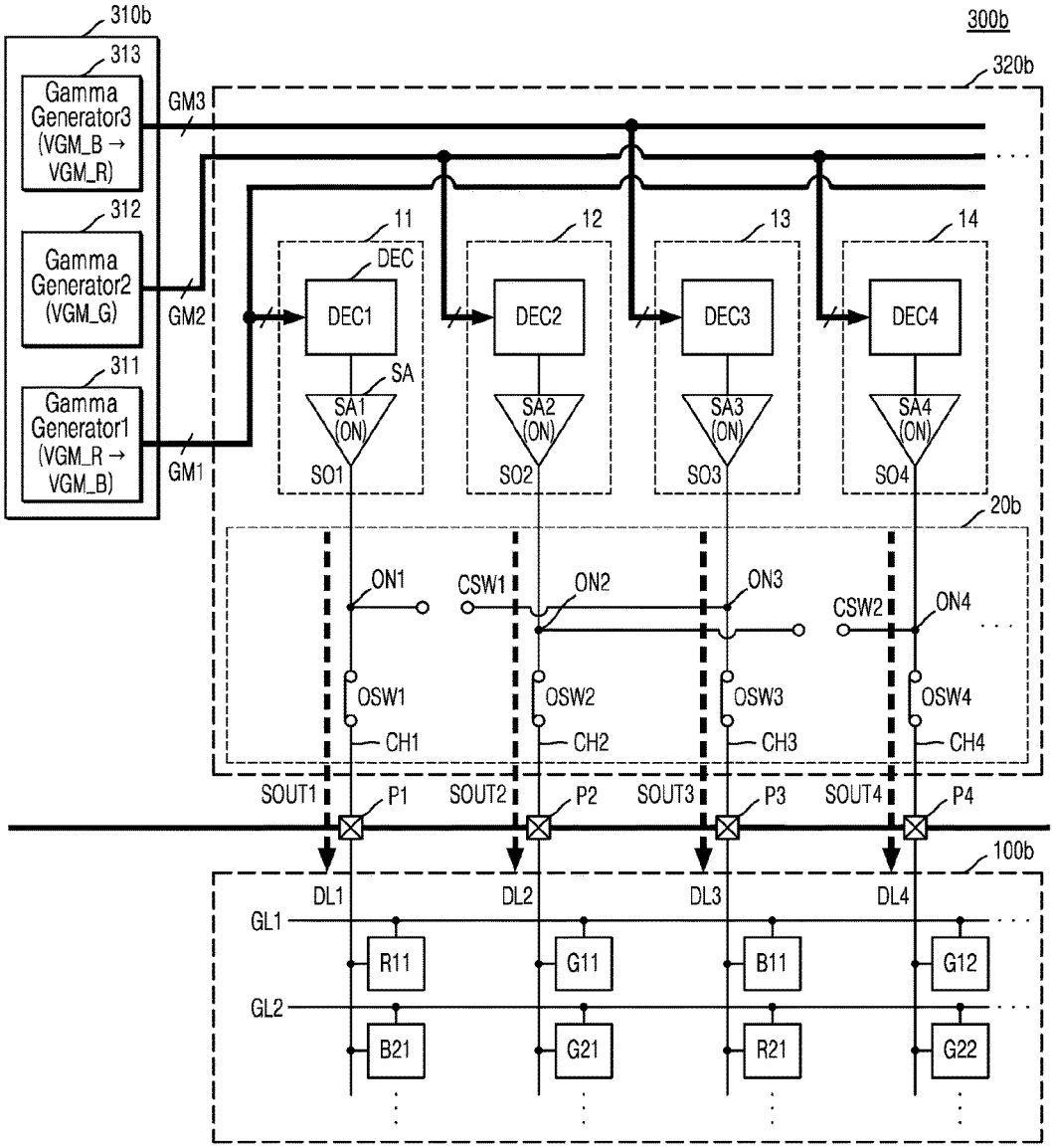
FIG. 10 illustrates an operation of the data driver of FIG. 8 in a normal mode.
Figure 11A:
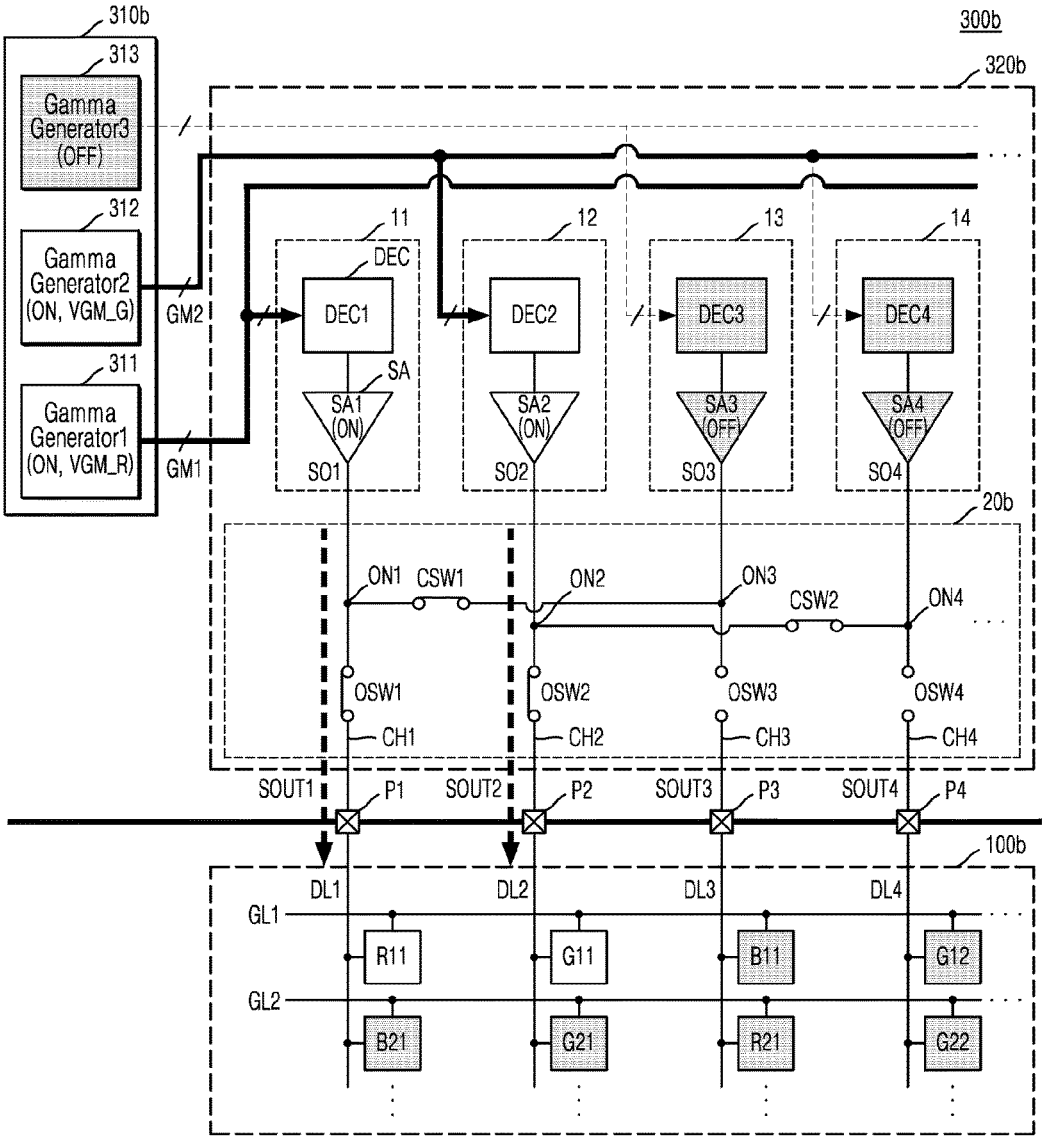
FIGS. 11A and 11B illustrate an operation of the data driver of FIG. 8 in a low power mode.
Figure 11B:
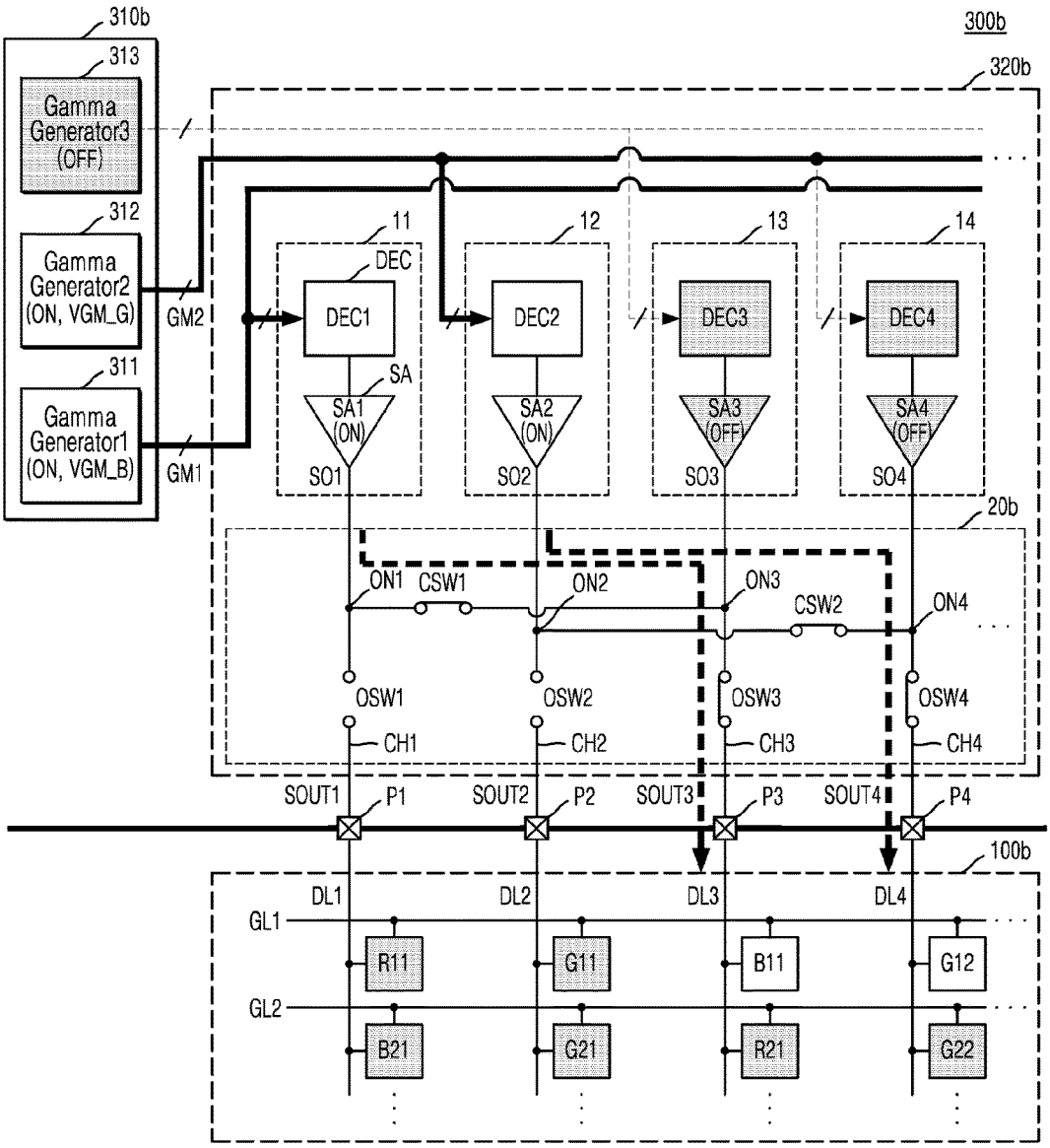

FIG. 9 is a timing diagram showing signals of the data driver 300*b* of FIG. 8. FIG. 10 illustrates an operation of the data driver 300*b* of FIG. 8 in a normal mode. FIGS. 11A and 11B illustrate an operation of the data driver 300*b* of FIG. 8 in a low power mode.

Referring to FIGS. 9 and 10, in the normal mode, the first to third gamma voltage generators 311 to 313 may be enabled, and the first to fourth channel drivers 11 to 14 may be enabled.

During an odd-numbered horizontal driving period H1 in the normal mode, the first gamma voltage generator 311 may generate a red gamma voltage set VGM_R as the first gamma voltage set GM1, the second gamma voltage generator 312 may generate a green gamma voltage set VGM_G as the second gamma voltage set GM2, and the third gamma voltage generator 313 may generate a blue gamma voltage set VGM_B as the third gamma voltage set GM3. The first to fourth channel drivers 11 to 14 may generate image signals corresponding to pixels R1, G11, B11, and G12 of a first line, respectively. The image signals may be respectively output as first to fourth channel amplifier outputs SO1 to SO4.

During an even-numbered horizontal driving period H2 in the normal mode, the first gamma voltage generator 311 may generate the blue gamma voltage set VGM_B as the first gamma voltage set GM1, the second gamma voltage generator 312 may generate the green gamma voltage set VGM_G as the second gamma voltage set GM2, and the third gamma voltage generator 313 may generate the red gamma voltage set VGM_R as the third gamma voltage set GM3. The first to fourth channel drivers 11 to 14 may generate image signals corresponding to pixels B21, G21, R21, and G22 of a second line, respectively. The image signals may be respectively output as first to fourth channel amplifier outputs SO1 to SO4.

In the normal mode, the low power enable signal LPMEN may be at a logic low level, and the output enable signals OEN1 and OEN2 may be at a logic high level. Therefore, the connection switches CSW1 and CSW2 may be turned off, and the output switches OSW1 to OSW4 may be turned on. Accordingly, the first to fourth channel amplifier outputs SO1 to SO4 may be supplied to the first to fourth data lines DL1 to DL4 as the first to fourth output signals SOUT1 to SOUT4, respectively.

Hereinafter, an operation of the data driver 300*b* in the low power mode will be described with reference to FIGS. 9, 11A, and 11B. A frame frequency F_LPM of the low power mode may be set relatively lower than a frame frequency F_NM of the normal mode. Therefore, a length of one horizontal driving period in the low power mode may be longer than that of one horizontal driving period in the normal mode. First and second periods T1 and T2 of first to third periods T1 to T3 included in one horizontal driving period may each be a data charging period, and the third period T3 may be a data holding period.

Referring to FIGS. 9, 11A, and 11B, in the low power mode, the first gamma voltage generator 311 and the second gamma voltage generator 312 may be enabled, and the third gamma voltage generator 313 may be disabled. Also, the first channel driver 11 and the second channel driver 12 may be enabled, and the third channel driver 13 and the fourth channel driver 14 may be disabled. An output GM3 of the third gamma voltage generator 313 and the third and fourth channel amplifier outputs SO03 and SO04 may be floated (for example, a high impedance state).

During one horizontal driving period in the low power mode, the first channel driver 11 may sequentially generate two image signals and may respectively supply the generated image signals to the first and third data lines DL1 and DL3. Also, during the one horizontal driving period, the second channel driver 12 may sequentially generate two image signals and may respectively supply the generated image signals to the second and fourth data lines DL2 and DL4. An operation in the odd-numbered horizontal driving period H1 in the low power mode will be described for example.

For example, during first and second periods T1 and T2 of the odd-numbered horizontal driving period H1 in the low power mode, the first channel driver 11 may sequentially generate image signals corresponding to the red pixel R11 and the blue pixel B11 of the first line. To this end, the first gamma voltage generator 311 may generate the red gamma voltage set VGM_R corresponding to the red pixel R11 during the first period T1 and may generate the blue gamma voltage set VGM_B corresponding to the blue pixel B11 during the second period T2.

During the first and second periods T1 and T2 of the odd-numbered horizontal driving period H1, the second channel driver 12 may sequentially generate image signals corresponding to a first green pixel G11 and a second green pixel G12 of the first line. Therefore, the second gamma voltage generator 312 may continuously generate the green gamma voltage set VGM_G.

During the first and second periods T1 and T2, image signals corresponding to the red pixel R11 and the blue pixel B11 may be sequentially output as the first channel amplifier output SO1, and image signals corresponding to the first green pixel G11 and the second green pixel G12 may be sequentially output as the second channel amplifier output SO02.

In the low power mode, the low power enable signal LPMEN may be at a logic high level, and the first and second output enable signals OEN1 and OEN2 may be sequentially shifted to a logic high level. Therefore, the connection switches CSW1 and CSW2 may be turned on, the first and second output switches OSW1 and OSW2 may be turned on during the first period T1, and the third and fourth output switches OSW3 and OSW4 may be turned on during the second period T2.

As illustrated in FIG. 11A, during the first period T1 in the low power mode, the first channel amplifier output SO1 and the second channel amplifier output SO02 may be sequentially output as the first output signal SOUT1 and the second output signal SOUT2. Therefore, during the first period T1, the first channel driver 11 and the second channel driver 12 may supply image signals corresponding to the red pixel R11 and the first green pixel G11 to the first data line DL1 and the second data line DL2 through the first channel CH1 and the second channel CH2, respectively.

As illustrated in FIG. 11B, during the second period T2 in the low power mode, the first channel amplifier output SO1 and the second channel amplifier output SO2 may be sequentially output as the third output signal SOUT3 and the fourth output signal SOUT4. Therefore, during the second period T2, the first channel driver 11 and the second channel driver 12 may supply image signals corresponding to the blue pixel B11 and the second green pixel G12 to the third data line DL3 and the fourth data line DL4 through the third channel CH3 and the fourth channel CH4, respectively.

An operation in an even-numbered horizontal driving period H2 in the low power mode is similar to the operation in the odd-numbered horizontal driving period H1 in the low power mode. Unlike the odd-numbered horizontal driving period H1, the first channel driver 11 may generate an image signal corresponding to a blue pixel B21 during the first period T1 and may generate an image signal corresponding to a red pixel R21 during the second period T2. Therefore, the first gamma voltage generator 311 may generate the blue gamma voltage set VGM_B during the first period T1 and may generate the red gamma voltage set VGM_R during the second period T2.

Figure 12:
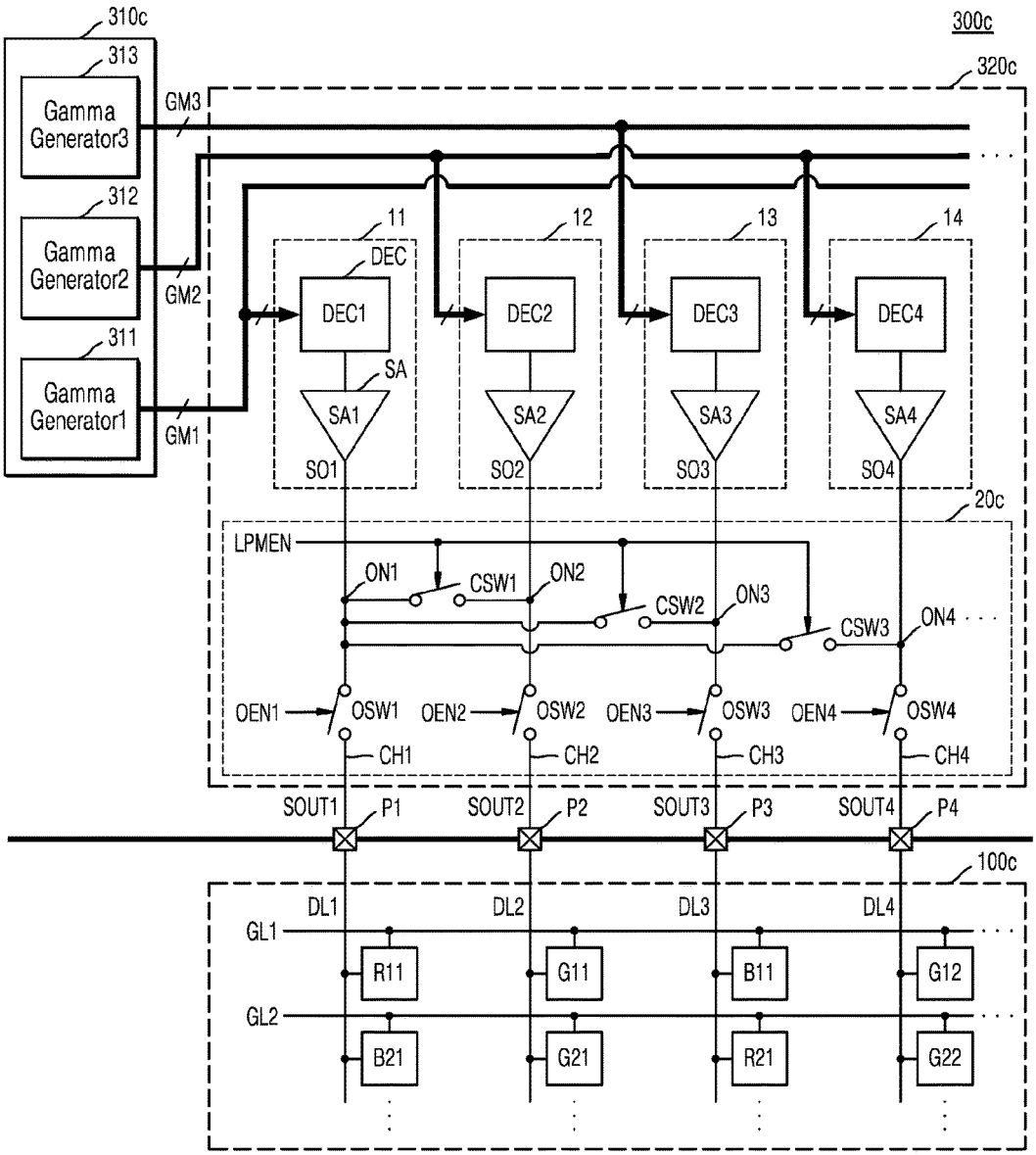
FIG. 12 is a circuit diagram illustrating a data driver according to an exemplary embodiment.

FIG. 12 is a circuit diagram illustrating a data driver 300*c* according to an exemplary embodiment. FIG. 12 illustrates one implementation example of the data driver 300*c* for driving a display panel 100*c* having a pentile structure.

A structure of the data driver 300*c* of FIG. 12 is similar to that of the data driver 300*b* of FIG. 8. However, a structure of an output control circuit 20*c* differs from that of the output control circuit 20*b* of the data driver 300*b* illustrated in FIG. 8, and thus, the output control circuit 20*c* will be described below.

The output control circuit 20*c* may include a plurality of output switches OSW1 to OSW4 and a plurality of connection switches CSW1 to CSW3. The plurality of output switches OSW1 to OSW4 may be turned on or off in response to output enable signals OEN1 to OEN4, and the connection switches CSW1 to CSW3 may be turned on or off in response to a low power enable signal LPMEN. The output switches OSW1 to OSW4 may be turned on and may electrically connect a plurality of output nodes ON1 to ON4 to a plurality of channels CH1 to CH4, respectively. A first connection switch CSW1 may be turned on and may electrically connect a first output node ON1 to a second output node ON2. A second connection switch CSW2 may be turned on and may electrically connect the first output node ON1 to a third output node ON3. A third connection switch CSW3 may be turned on and may electrically connect the first output node ON1 to a fourth output node ON4.

An operation of the data driver 300*c* of FIG. 12 in the normal mode is as described above with reference to FIG. 10. Thus, repetitive descriptions are omitted.

An operation of the data driver 300*c* of FIG. 12 in the low power mode will be described in detail with reference to FIGS. 13 and 14.

Figure 13:
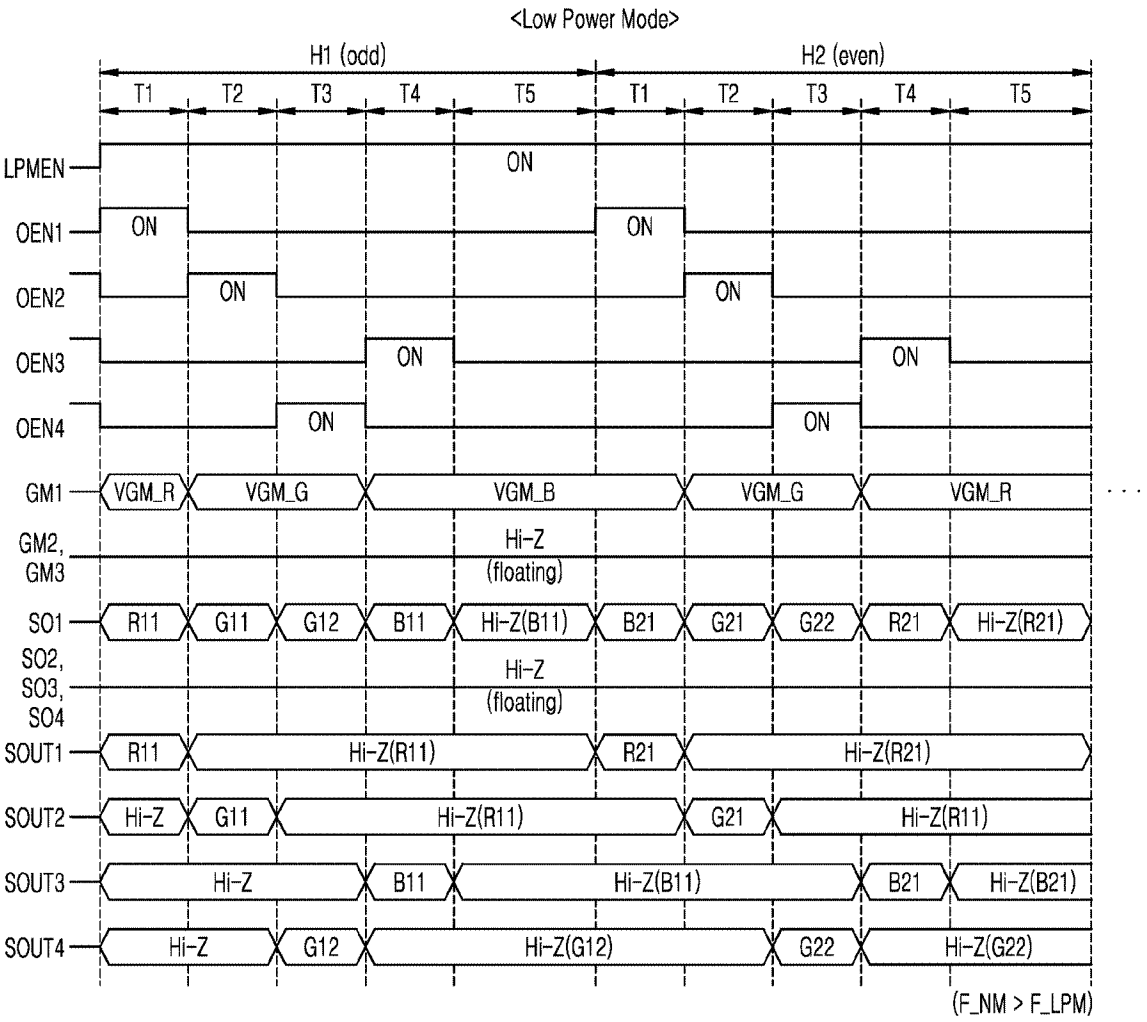
FIG. 13 is a timing diagram showing signals of the data driver of FIG. 12 in a low power mode.
Figure 14:
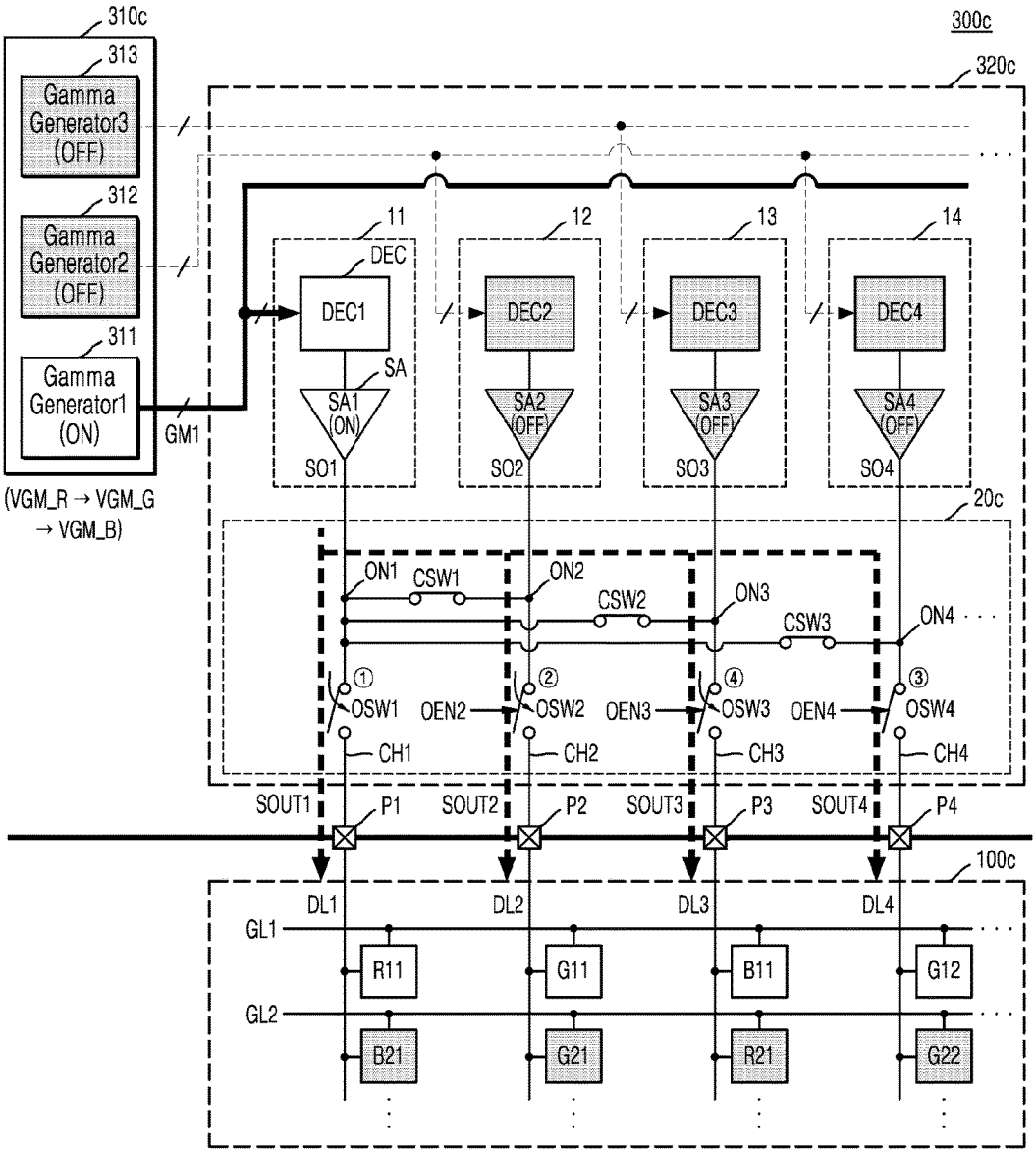
FIG. 14 illustrates an operation of the data driver of FIG. 12 in a low power mode.

FIG. 13 is a timing diagram showing signals of the data driver 300*c* of FIG. 12 in a low power mode, FIG. 14 illustrates an operation of the data driver 300*c* of FIG. 12 in a low power mode. A frame frequency F_LPM of the low power mode may be set relatively lower than a frame frequency F_NM of the normal mode. First to fourth periods T1 to T4 of first to fifth periods T1 to T5 included in one horizontal driving period may each be a data charging period, and the fifth period T5 may be a data holding period.

Referring to FIGS. 13 and 14, in the low power mode, the first gamma voltage generator 311 may be enabled, and the second gamma voltage generator 312 and the third gamma voltage generator 313 may be disabled. Also, the first channel driver 11 may be enabled, and the second to fourth channel drivers 12 to 14 may be disabled. Therefore, outputs GM2 and GM3 of the second and third gamma voltage generators 312 and 313 may be floated, and the second to fourth channel amplifier outputs SO2 to SO4 may be floated (for example, a high impedance state).

During one horizontal driving period in the low power mode, the enabled first channel driver 11 may sequentially generate four image signals and may sequentially supply the generated image signals to first to fourth data lines DL1 to DL4. An operation in an odd-numbered horizontal driving period (i.e., a first horizontal driving period) H1 will be described below for example.

The first channel driver 11 may sequentially generate image signals corresponding to a red pixel R11, a first green pixel G11, a second green pixel G12, and a blue pixel B11 of a first line during the first to fourth periods T1 to T4 of the first horizontal driving period H1 in the low power mode.

To this end, the first gamma voltage generator 311 may generate a red gamma voltage set VGM_R during the first period T1, generate a green gamma voltage set VGM_G during the second period T2 and the third period T3, and generate a blue gamma voltage set VGM_B during the fourth period T4. The image signals which are generated in the first to fourth periods T1 to T4 may be sequentially output as a first channel amplifier output SO1.

Therefore, the connection switches CSW1 and CSW2 may be turned on, a first output switch OSW1 may be turned on during the first period T1, a second output switch OSW2 may be turned on during the second period T2, a fourth output switch OSW4 may be turned on during the third period T3, and a third output switch OSW3 may be turned on during the fourth period T4.

As illustrated in FIG. 14, a first channel amplifier output SO1 may be sequentially output as first to fourth output signals SOUT1 to SOUT4 during the first to fourth periods T1 to T4. Therefore, an image signal corresponding to the red pixel R11 may be supplied to the first data line DL1 through a first channel CH1 during the first period T1, an image signal corresponding to the first green pixel G11 may be supplied to the second data line DL2 through a second channel CH2 during the second period T2, an image signal corresponding to the second green pixel G12 may be supplied to the fourth data line DL4 through a fourth channel CH4 during the third period T3, and an image signal corresponding to the blue pixel B11 may be supplied to the third data line DL3 through a third channel CH3 during the fourth period T4. In this manner, the first channel driver 11 may time-divisionally drive the first to fourth data lines DL1 to DL4.

An operation in an even-numbered horizontal driving period in the low power mode is similar to the operation in the odd-numbered horizontal driving period in the low power mode. Unlike the odd-numbered horizontal driving period, the first channel driver 11 may generate an image signal corresponding to a blue pixel B21 during the first period T1 and may generate an image signal corresponding to a red pixel R21 during the fourth period T4. Therefore, the first gamma voltage generator 311 may generate the blue gamma voltage set VGM_B during the first period T1 and may generate the red gamma voltage set VGM_R during the fourth period T4.

Figure 15:
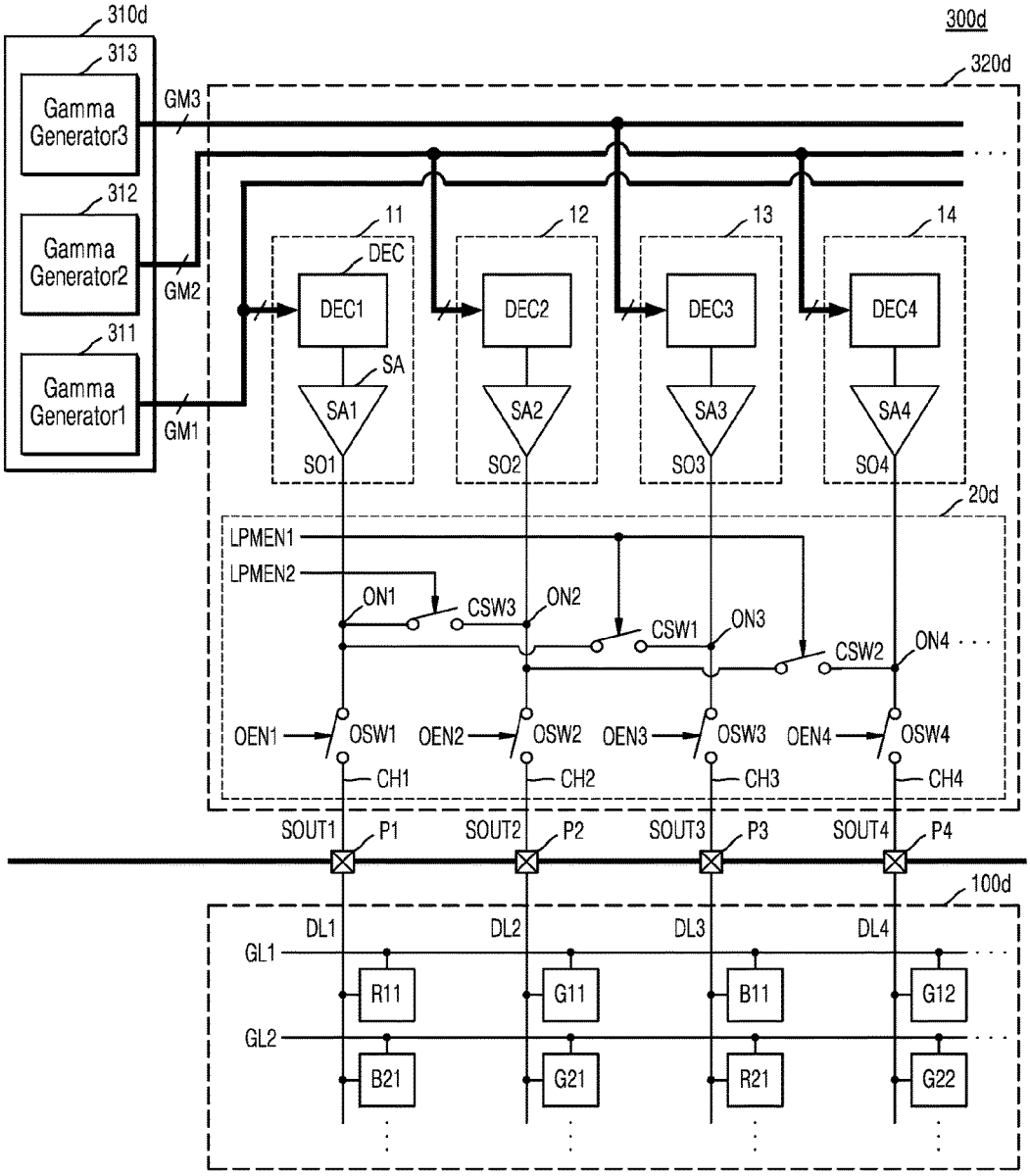
FIG. 15 is a circuit diagram illustrating a data driver according to an exemplary embodiment.

FIG. 15 is a circuit diagram illustrating a data driver 300*d* according to an exemplary embodiment. FIG. 15 illustrates one implementation example of the data driver 300*d* for driving a display panel 100*d* having a pentile structure.

A structure of the data driver 300*d* of FIG. 15 is similar to that of each of the data driver 300*b* of FIG. 8 and the data driver 300*c* of FIG. 12. However, a structure of an output control circuit 20*d* differs from that of each of the output control circuit 20*b* of the data driver 300*b* illustrated in FIG. 8 and the output control circuit 20*c* of the data driver 300*c* illustrated in FIG. 12, and thus, the output control circuit 20*d* will be described below.

The output control circuit 20*d* may include a plurality of output switches OSW1 to OSW4 and a plurality of connection switches CSW1 to CSW3. The plurality of output switches OSW1 to OSW4 may be turned on or off in response to output enable signals OEN1 to OEN4. First and second connection switches CSW1 and CSW2 may be turned on or off in response to a first low power enable signal LPMEN1. Third connection switch CSW3 may be turned on or off in response to a second low power enable signal LPMEN2.

The output switches OSW1 to OSW4 may be turned on and may electrically connect a plurality of output nodes ON1 to ON4 to a plurality of channels CH1 to CH4, respectively. The first connection switch CSW1 may be turned on and may electrically connect a first output node ON1 to a third output node ON3, and the second connection switch CSW2 may be turned on and may electrically connect a second output node ON2 to a fourth output node ON4. The third connection switch CSW3 may be turned on and may electrically connect the first output node ON1 to the second output node ON2.

Figure 16:
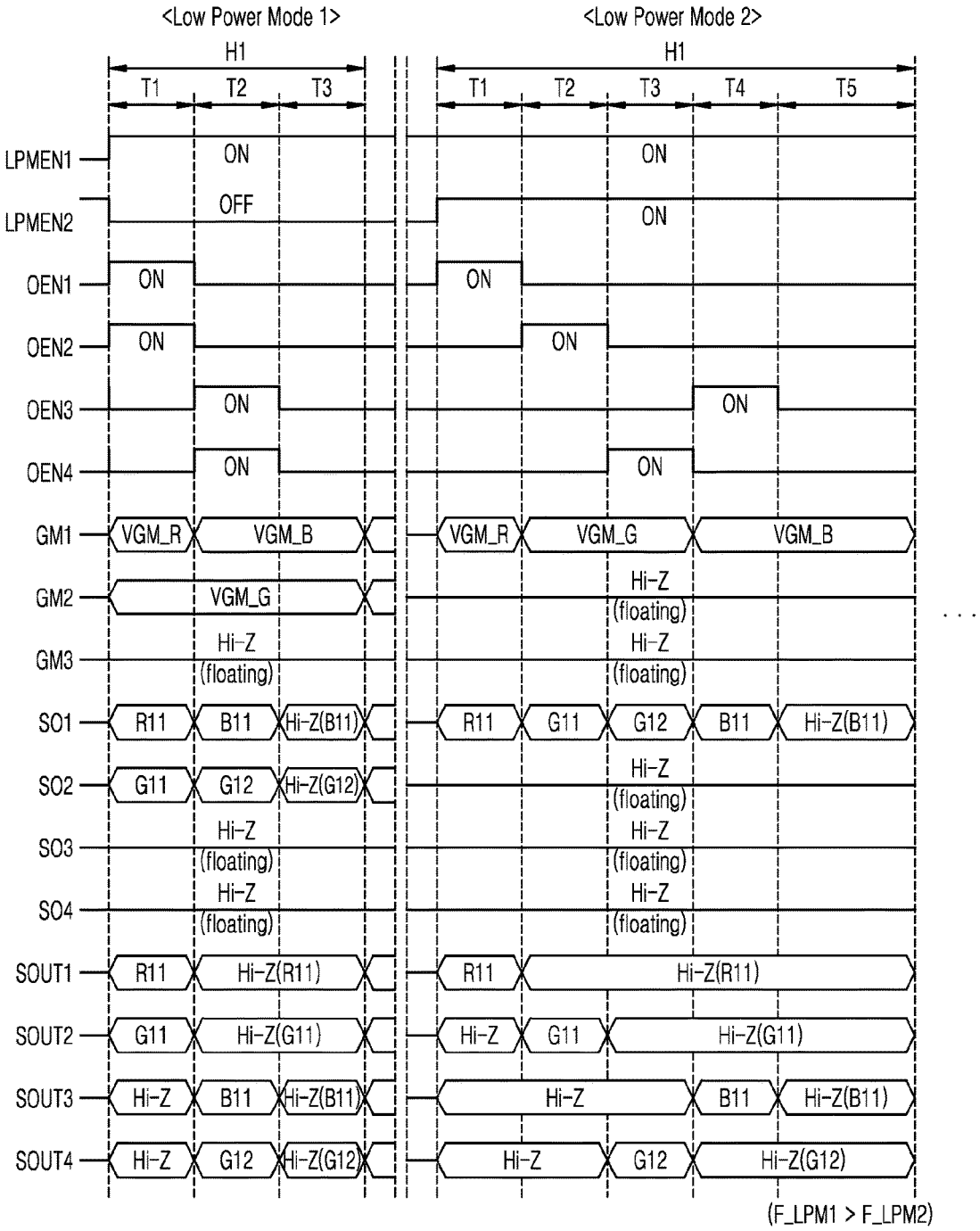
FIG. 16 is a timing diagram showing signals of the data driver of FIG. 15 in a low power mode.

FIG. 16 is a timing diagram showing signals of the data driver 300*d* of FIG. 15 in a low power mode.

An operation of the data driver 300*d* of FIG. 15 in the normal mode is as described above with reference to FIG. 10. Thus, repetitive descriptions are omitted. The data driver 300*d* of FIG. 15 may operate in a first low power mode (Low Power Mode 1) and a second low power mode (Low Power Mode 2). A frame frequency F_LPM2 of the second low power mode may be set relatively lower than a frame frequency F_LPM1 of the first low power mode. The frame frequencies F_LPM1 and F_LPM2 may both be set relatively lower than a frame frequency in a normal mode.

In the first low power mode, an operation of the data driver 300*d* is similar to that of the data driver 300*b* described above with reference to FIGS. 9, 11A, and 11B. The first gamma voltage generator 311 and the second gamma voltage generator 312 may be enabled, and the third gamma voltage generator 313 may be disabled. Also, the first channel driver 11 and the second channel driver 12 may be enabled, and the third channel driver 13 and the fourth channel driver 14 may be disabled.

In the first low power mode, the first low power enable signal LPMEN1 may be at a logic high level, and the second low power enable signal LPMEN2 may be at a logic low level. Therefore, the first and second connection switches CSW1 and CSW2 may be turned on, and the third connection switch CSW3 may be turned off. Accordingly, the first output node ON1 may be electrically connected to the third output node ON3, and the second output node ON2 may be electrically connected to the fourth output node ON4.

During a first period T1, first and second output enable signals OEN1 and OEN2 may be shifted to a logic high level, and first and second output switches OSW1 and OSW2 may be turned on. Therefore, during the first period T1, an output (i.e., a first channel amplifier output SO1) of the first channel driver 11 may be supplied to a first channel CH1, and a second channel amplifier output SO2 may be supplied to a second channel CH2.

Moreover, during a second period T2, third and fourth output enable signals OEN3 and OEN4 may be shifted to a logic high level, and third and fourth output switches OSW3 and OSW4 may be turned on. Therefore, during the second period T2, the output (i.e., the first channel amplifier output SO1) of the first channel driver 11 may be supplied to a third channel CH3, and a fourth channel amplifier output SO4 may be supplied to a fourth channel CH4.

Therefore, during the first low power mode, in a state where the third gamma voltage generator 313, the third channel driver 13, and the fourth channel driver 14 are disabled, the first channel driver 11 may time-divisionally drive first and third data lines DL1 and DL3, and the second channel driver 12 may time-divisionally drive second and fourth data lines DL2 and DL4.

In the second low power mode (Low Power Mode 2), an operation of the data driver 300*d* is similar to that of the data driver 300*c* described above with reference to FIGS. 13 and 14. The first gamma voltage generator 311 may be enabled, and the second gamma voltage generator 312 and the third gamma voltage generator 313 may be disabled. Also, the first channel driver 11 may be enabled, and the second channel driver 12, the third channel driver 13 and the fourth channel driver 14 may be disabled.

In the second low power mode, the first low power enable signal LPMEN1 and the second low power enable signal LPMEN2 may be at a logic high level. Therefore, the first to third connection switches CSW1 to CSW3 may be turned on. Accordingly, the first to fourth output nodes ON1 to ON4 may be electrically connected to each other.

The first to fourth output enable signals OEN1 to OEN4 may be sequentially shifted to a logic high level. At this time, the fourth output enable signal OEN4 may be shifted to a logic high level prior to the third output enable signal OEN3. The first output switch OSW1 may be turned on during the first period T1, the second output switch OSW2 may be turned on during the second period T2, the fourth output switch OSW4 may be turned on during a third period T3, and the third output switch OSW3 may be turned on during a fourth period T4. Accordingly, during the first to fourth periods T1 to T4, the output (i.e., the first channel amplifier output SO1) of the first channel driver 11 may be sequentially supplied to the first to fourth channels CH1 to CH4. That is, the output of the first channel driver 11 is sequentially output to CH1, CH2, CH4, and CH3, since the fourth output enable signal OEN4 is shifted to the logic high level prior to the third output enable signal OEN3.

Therefore, during the second low power mode, in a state where the second gamma voltage generator 312, the third gamma voltage generator 313, and the second to fourth channel drivers 12 to 14 are disabled, the first channel driver 11 may time-divisionally drive the first to fourth data lines DL1 to DL4 in the order of DL1, DL2, DL4, DL3.

Figure 17:
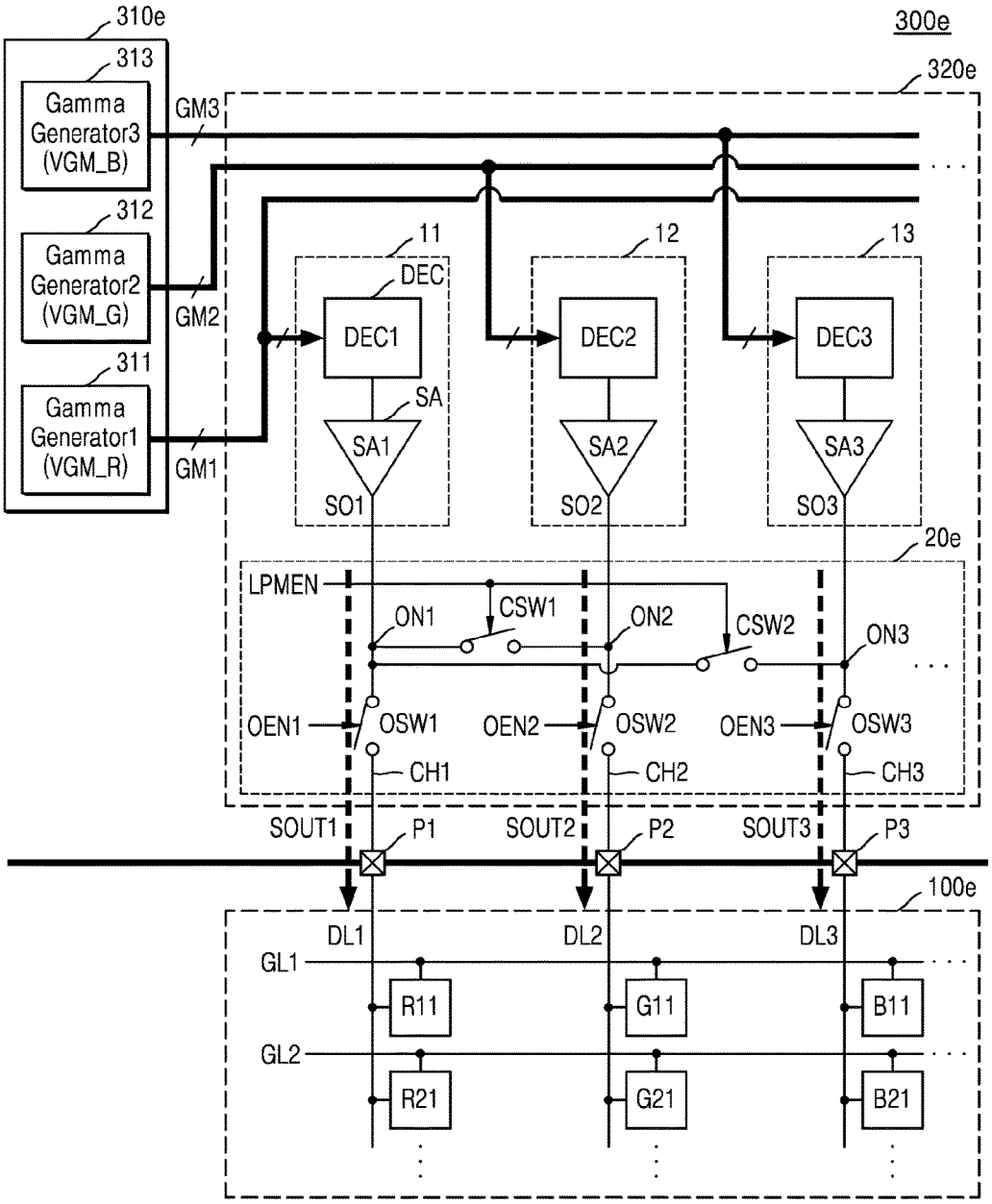
FIG. 17 is a circuit diagram illustrating a data driver according to an exemplary embodiment.

FIG. 17 is a circuit diagram illustrating a data driver 300*e* according to an exemplary embodiment. FIG. 17 illustrates one implementation example of the data driver 300*e* for driving a display panel 100*e* having an RGB structure where a red pixel, a green pixel, and a blue pixel are sequentially arranged.

A structure and an operation of the data driver 300*e* of FIG. 17 are similar to those of the data driver 300*a* described above with reference to FIGS. 3 to 6C. Thus, repetitive descriptions are omitted. In the normal mode, a first gamma voltage generator 311 may generate a red gamma voltage set VGM_R, a second gamma voltage generator 312 may generate a green gamma voltage set VGM_G, and a third gamma voltage generator 313 may generate a blue gamma voltage set VGM_B. A first data driver 11 may generate an image signal corresponding to red pixels R11 and R21, based on the red gamma voltage set VGM_R and may supply the generated image signal to a first data line DL1. A second data driver 12 may generate an image signal corresponding to green pixels G11 and G21, based on the green gamma voltage set VGM_G and may supply the generated image signal to a second data line DL2. A third data driver 13 may generate an image signal corresponding to blue pixels B11 and B21, based on the blue gamma voltage set VGM_B and may supply the generated image signal to a third data line DL3.

An operation of the data driver 300*e* of FIG. 17 in the low power mode will be described in detail with reference to FIGS. 18 to 19B.

Figure 18:
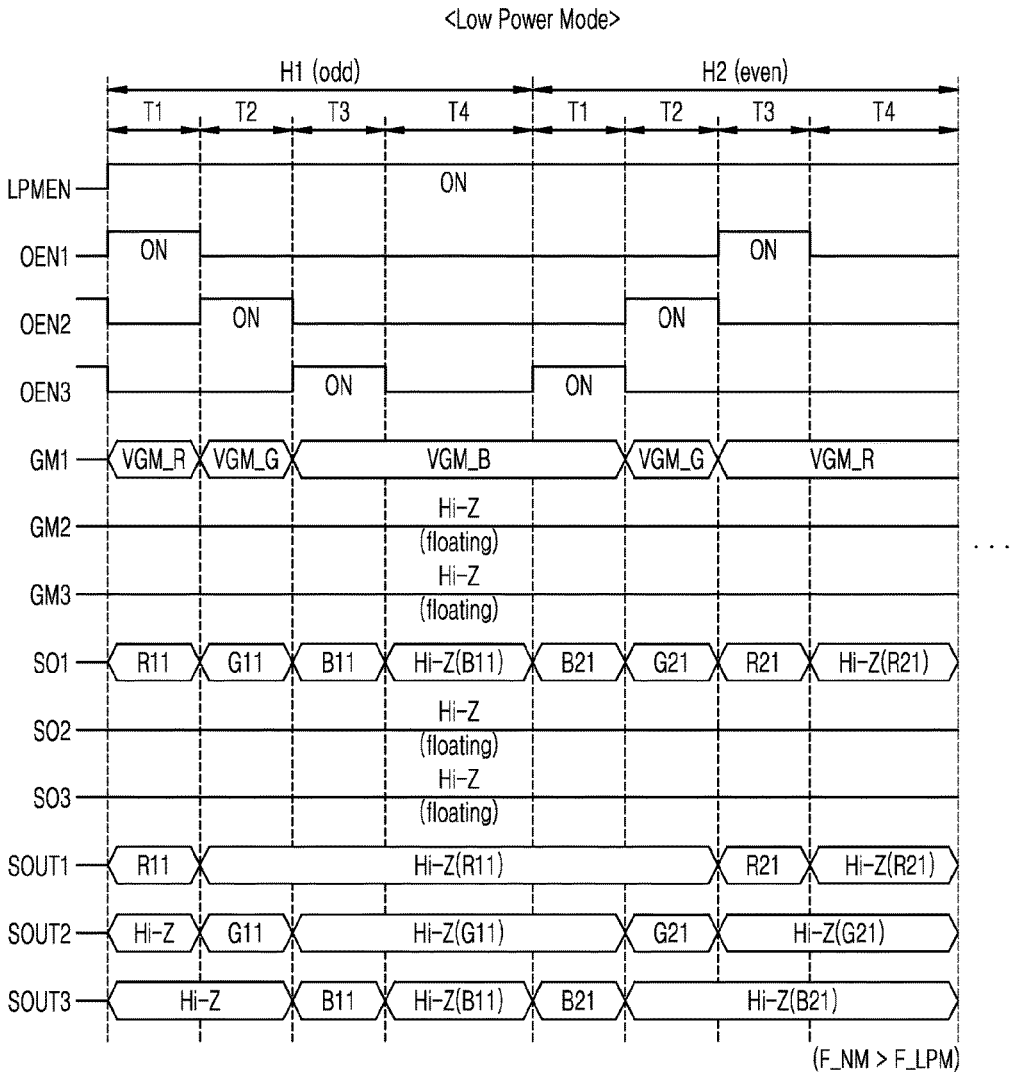
FIG. 18 is a timing diagram showing signals of the data driver of FIG. 17 in a low power mode.
Figure 19A:
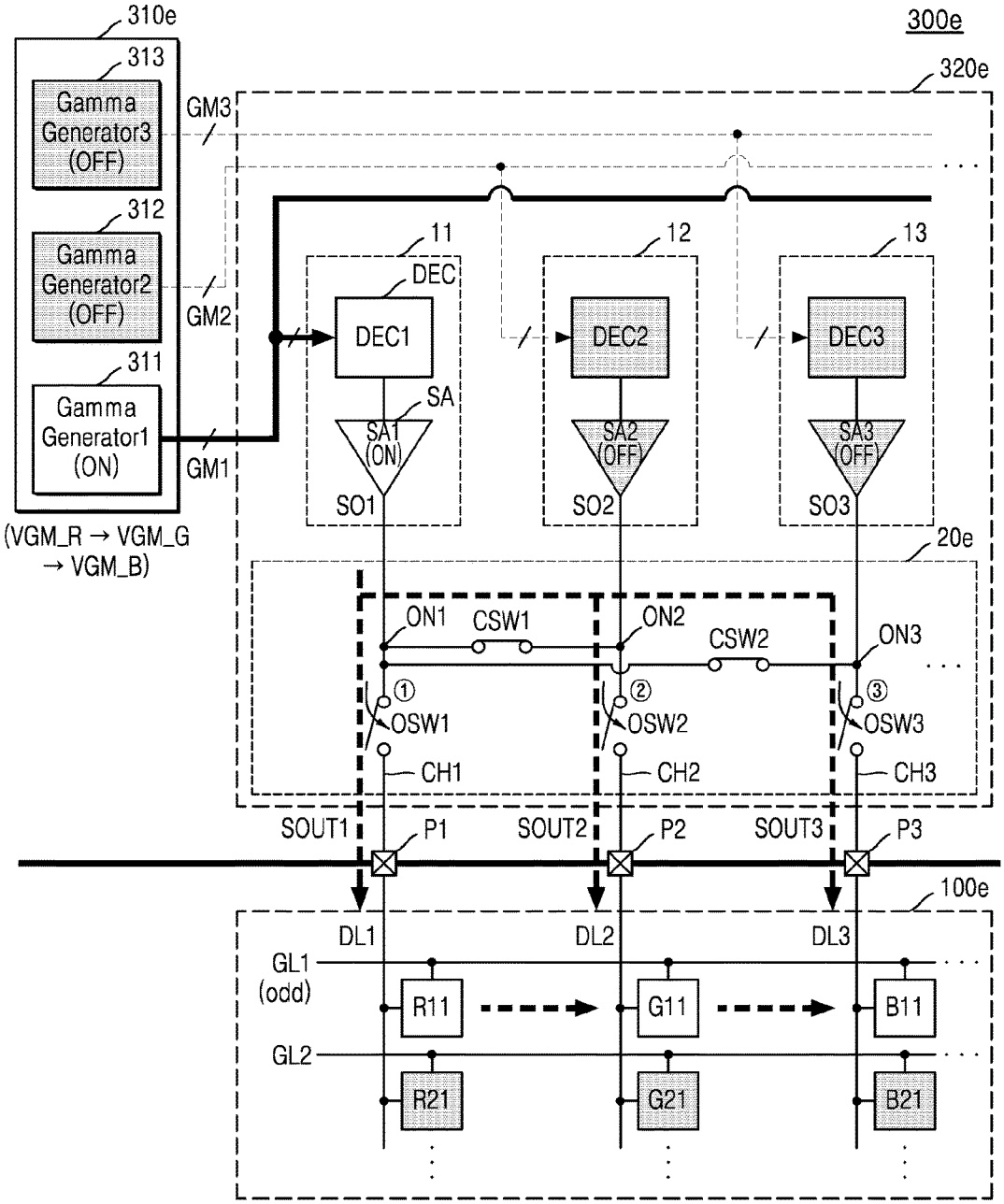
FIGS. 19A and 19B illustrate an operation of the data driver of FIG. 17 in the low power mode.
Figure 19B:
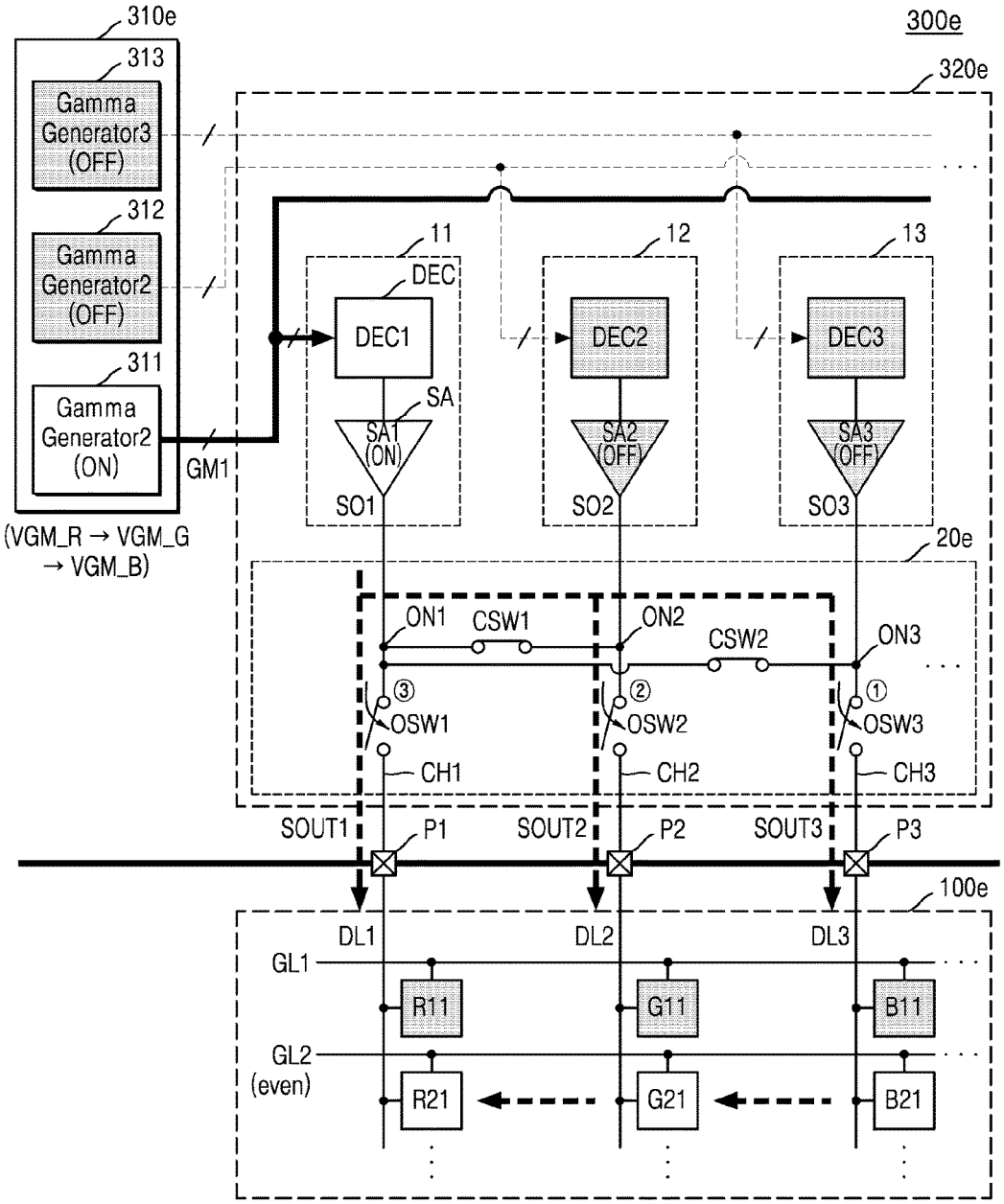

FIG. 18 is a timing diagram showing signals of the data driver 300*e* of FIG. 17 in a low power mode, and FIGS. 19A and 19B illustrate an operation of the data driver 300*e* of FIG. 17 in the low power mode.

Referring to FIG. 18, in the low power mode, the first gamma voltage generator 311 may be enabled, and the second and third gamma voltage generators 312 and 313 may be disabled. Also, a first channel driver 11 corresponding to the first gamma voltage generator 311 may be enabled, and second and third channel drivers 12 and 13 corresponding to the second and third gamma voltage generators 312 and 313 may be disabled.

During one horizontal driving period in the low power mode, the first channel driver 11 may sequentially generate image signals corresponding to the red pixels R11 and R21, the green pixels G11 and G21, and the blue pixels B11 and B21 and may sequentially supply the generated image signals to the first to third data lines DL1 to DL3.

In this case, as illustrated in FIG. 19A, in driving an odd-numbered line, the first channel driver 11 may drive the red pixel R11, the green pixel G11, and the blue pixel B11 in order, and as illustrated in FIG. 19B, in driving an even-numbered line, the first channel driver 11 may drive the blue pixel B21, the green pixel G21, and the red pixel R21 in order. In this manner, in driving the odd-numbered line and the even-numbered line, as illustrated in FIG. 18, a change in output (setting of the first gamma voltage set GM1) of the first gamma voltage generator 311 is minimized by changing a driving order.

Figure 20:
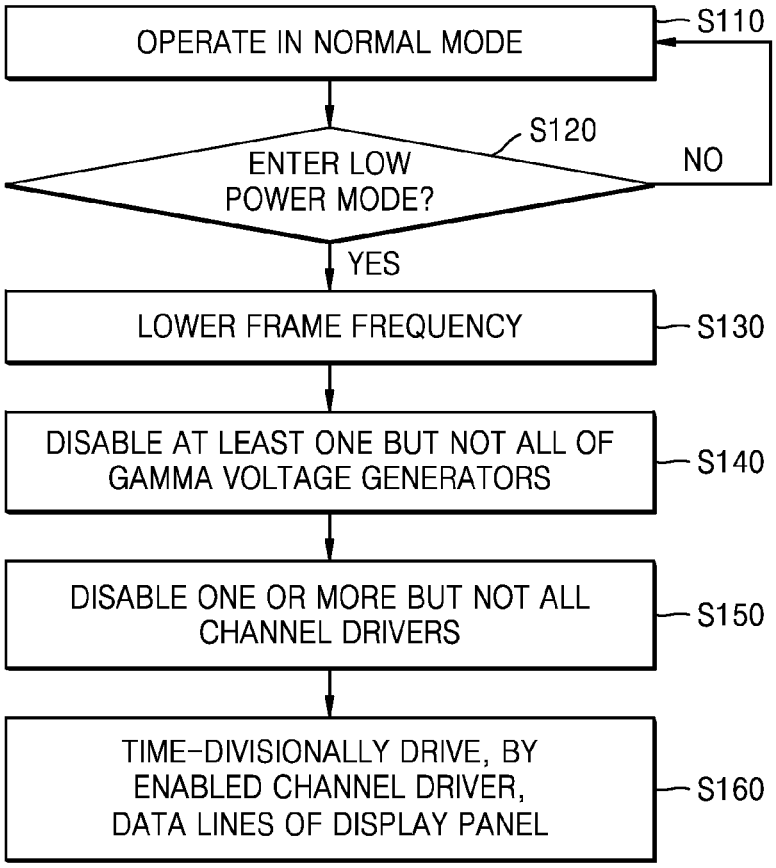
FIG. 20 is a flowchart illustrating an operating method of a display driving circuit according to an exemplary embodiment.

FIG. 20 is a flowchart illustrating an operating method of a display driving circuit according to an exemplary embodiment. The operating method of FIG. 20 may be applied to the display apparatus of FIG. 1. The details described above with reference to FIGS. 1 to 19B may be applied to the present exemplary embodiment.

Referring to FIG. 20, in operation S110, the display driving circuit may operate in the normal mode. When the display driving circuit operates in the normal mode, a plurality of gamma voltage generators included in a gamma block may be enabled to operate, and a plurality of channel drivers included in a driving block may be enabled to operate. Each of the plurality of channel drivers may drive a corresponding data line of a display panel.

In operation S210, the display driving circuit may determine whether to enter the low power mode. For example, a timing controller (200 of FIG. 1) may make a determination which allows the display apparatus to operate in the low power mode, in response to a low power mode request signal from an external device (for example, a host). Alternatively, the timing controller may analyze received image data and may determine whether to enter the low power mode of the display apparatus, based on a result of the analysis.

When it is determined to enter the low power mode (operation S120, YES), a frame frequency may be set to be low in operation S130. The timing controller may lower the frame frequency and may generate a data driver control signal and a gate driver control signal based on the set lower frame frequency so that the image data is displayed on a display panel according to the set lower frame frequency.

In operation S140, at least one but not all of the plurality of gamma voltage generators may be disabled. Also, one or more but not all of the plurality of channel drivers may be disabled in operation S150. In an exemplary embodiment, the disabled channel drivers may be channel drivers corresponding to the disabled gamma voltage generator(s). The control logic (500 of FIG. 1) may generate a mode control signal (MCTRL of FIG. 1) based on the low power mode and may supply the mode control signal to a data driver (300 of FIG. 1). The data driver may perform an operation based on the low power mode, based on a plurality of control signals included in the mode control signal. Accordingly, at least one but not all of the plurality of gamma voltage generators may be disabled, and one or more but not all of the plurality of channel drivers may be disabled.

In operation S160, the enabled channel driver may time-divisionally drive a plurality of data lines included in the display panel. The enabled channel driver may sequentially generate a plurality of image signals, based on gamma voltages received from the enabled gamma voltage generator and may supply the plurality of image signals to the plurality of data lines during one horizontal driving period. In this case, the plurality of image signals may correspond to different colors. Accordingly, the enabled gamma voltage generator may generate the plurality of gamma voltages (i.e., a plurality of gamma voltage sets) corresponding to the different colors during the one horizontal driving period.

While the inventive concept has been particularly shown and described with reference to exemplary embodiments thereof, it will be understood that various changes in form and details may be made therein without departing from the spirit and scope of the following claims.

What is claimed is:

1. A display driving circuit comprising:

a first gamma voltage generator configured to supply a first gamma voltage set;

a second gamma voltage generator configured to supply a second gamma voltage set;

a first channel driver configured to receive the first gamma voltage set and select one gamma voltage from among gamma voltages of the first gamma voltage set to output the selected one gamma voltage; and a second channel driver configured to receive the second gamma voltage set and select one gamma voltage from among gamma voltages of the second gamma voltage set to output the selected one gamma voltage, wherein in a first operation mode, the first channel driver and the second channel driver respectively drive a first data line and a second data line of a display panel, and in a second operation mode, the second gamma voltage generator and the second channel driver are disabled, and the first channel driver time-divisionally drives the first data line and the second data line, based on the first gamma voltage set.

2. The display driving circuit of claim 1, wherein a frame frequency of the second operation mode is lower than a frame frequency of the first operation mode.

3. The display driving circuit of claim 1, wherein, in the second operation mode, the first gamma voltage generator generates a plurality of first gamma voltages, corresponding to a first color, as the first gamma voltage set during a first sub period of a horizontal driving period and generates a plurality of second gamma voltages, corresponding to a second color, as the first gamma voltage set during a second sub period of the horizontal driving period.

4. The display driving circuit of claim 3, wherein, in the second operation mode, the first channel driver selects one first gamma voltage from among the plurality of first gamma voltages to output the selected one first gamma voltage to the first data line during the first sub period and selects one second gamma voltage from among the plurality of second gamma voltages to output the selected one second gamma voltage to the second data line during the second sub period.

5. The display driving circuit of claim 1, further comprising an output control circuit configured to control paths through which outputs of the first channel driver and the second channel driver are respectively supplied to the first data line and the second data line.

6. The display driving circuit of claim 5, wherein the output control circuit comprises:

a connection switch connected between a first output node of the first channel driver and a second output node of the second channel driver;

a first output switch connected between a first channel and the first output node; and a second output switch connected between a second channel and the second output node, and the first channel is connected to the first data line, and the second channel is connected to the second data line.

7. The display driving circuit of claim 6, wherein, in the second operation mode, the connection switch is turned on, and the first output switch and the second output switch are sequentially turned on.

8. The display driving circuit of claim 6, wherein, in the first operation mode, the connection switch is turned off, and the first output switch and the second output switch are turned on.

9. The display driving circuit of claim 1, further comprising:

a third gamma voltage generator configured to supply a third gamma voltage set; and a third channel driver configured to receive the third gamma voltage set and select one gamma voltage from among gamma voltages of the third gamma voltage set to output the selected one gamma voltage, wherein in the first operation mode, the third channel driver drives a third data line of the display panel, and in the second operation mode, the third gamma voltage generator and the third channel driver are disabled, and the first channel driver drives the first data line, the second data line, and the third data line.

10. The display driving circuit of claim 1, further comprising:

a third gamma voltage generator configured to supply a third gamma voltage set; and a third channel driver and a fourth channel driver each configured to receive the third gamma voltage set and select one gamma voltage from among gamma voltages of the third gamma voltage set to output the selected one gamma voltage.

11. The display driving circuit of claim 10, wherein in the first operation mode, the third channel driver and the fourth channel driver respectively drive a third data line and a fourth data line of the display panel, and in the second operation mode, the third gamma voltage generator and the third channel driver are enabled, the fourth channel driver is disabled, the first channel driver time-divisionally drives the first data line and the second data line, and the third channel driver time-divisionally drives the third data line and the fourth data line.

12. The display driving circuit of claim 11, wherein, in a third operation mode, the second gamma voltage generator, the third gamma voltage generator, the second channel driver, the third channel driver, and the fourth channel driver are disabled, and the first channel driver time-divisionally drives the first data line, the second data line, the third data line, and the fourth data line.

13. The display driving circuit of claim 12, wherein a frame frequency of the third operation mode is lower than a frame frequency of the second operation mode.

14. The display driving circuit of claim 10, wherein in the first operation mode, the third channel driver and the fourth channel driver respectively drive a third data line and a fourth data line of the display panel, and in the second operation mode, the third gamma voltage generator, the third channel driver, and the fourth channel driver are disabled, and the first channel driver time-divisionally drives the first data line, the second data line, the third data line, and the fourth data line.

15. The display driving circuit of claim 10, wherein a red pixel, a first green pixel, a blue pixel, and a second green pixel are sequentially arranged in one horizontal line of the display panel.

16. A data driver comprising:

a gamma block including a first gamma voltage generator and a second gamma voltage generator that each generate a plurality of gamma voltages; and a driving block including a plurality of first channel drivers receiving a plurality of gamma voltages from the first gamma voltage generator and a plurality of second channel drivers receiving another plurality of gamma voltages from the second gamma voltage generator, wherein, in a low power mode, the second gamma voltage generator and the plurality of second channel drivers are disabled, and the plurality of first channel drivers drive a plurality of data lines of a display panel, based on the plurality of gamma voltages supplied from the first gamma voltage generator.

17. The data driver of claim 16, wherein, in the low power mode, each of the plurality of first channel drivers time-divisionally drives at least two data lines during one horizontal driving period.

18. The data driver of claim 16, wherein, in a normal mode, the plurality of gamma voltages generated from the first gamma voltage generator and the plurality of gamma voltages generated from the second gamma voltage generator correspond to different colors.

19. The data driver of claim 16, wherein, in the low power mode, the first gamma voltage generator sequentially generates a plurality of first gamma voltages corresponding to a first color and a plurality of second gamma voltages corresponding to a second color.

20. The data driver of claim 16, wherein the driving block further comprises an output control circuit configured to control an output path of each of outputs of the plurality of first channel drivers and an output path of each of outputs of the plurality of second channel drivers.

* * * * *